US010684569B2

(12) United States Patent
Suzuki et al.

(10) Patent No.: US 10,684,569 B2
(45) Date of Patent: Jun. 16, 2020

(54) TONER SET, IMAGE FORMING METHOD, AND IMAGE FORMING APPARATUS

(71) Applicants: Kazumi Suzuki, Shizuoka (JP); Masaki Yoshino, Kanagawa (JP)

(72) Inventors: Kazumi Suzuki, Shizuoka (JP); Masaki Yoshino, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/333,892

(22) PCT Filed: Sep. 22, 2017

(86) PCT No.: PCT/JP2017/034373

§ 371 (c)(1),
(2) Date: Mar. 15, 2019

(87) PCT Pub. No.: WO2018/062052

PCT Pub. Date: Apr. 5, 2018

(65) Prior Publication Data

US 2019/0204760 A1 Jul. 4, 2019

(30) Foreign Application Priority Data

Sep. 30, 2016 (JP) ..... 2016-194464
Jun. 29, 2017 (JP) ..... 2017-127775

(51) Int. Cl.
*G03G 15/08* (2006.01)
*G03G 9/097* (2006.01)
(Continued)

(52) U.S. Cl.
CPC ..... *G03G 9/09758* (2013.01); *G03G 9/0819* (2013.01); *G03G 9/0821* (2013.01);
(Continued)

(58) Field of Classification Search
CPC ..... G03G 9/0821
See application file for complete search history.

(56) References Cited

U.S. PATENT DOCUMENTS

2003/0175608 A1 9/2003 Takagi et al.
2005/0147912 A1 7/2005 Takagi et al.
(Continued)

FOREIGN PATENT DOCUMENTS

JP 3-168756 * 7/1991 ..... G03G 9/09
JP 7-271081 A 10/1995
(Continued)

OTHER PUBLICATIONS

English translation of abstract of JP 3-168756.*
(Continued)

*Primary Examiner* — Peter L Vajda
(74) *Attorney, Agent, or Firm* — Oblon, McClelland, Maier & Neustadt, L.L.P.

(57) ABSTRACT

A toner set including a color toner including a binder resin and a colorant, and an invisible toner including a binder resin and a near infrared light-absorbing material, wherein 60-degree glossiness of a solid image of the invisible toner is 30 or greater, and the 60-degree glossiness of the solid image of the invisible toner is higher than 60-degree glossiness of a solid image of the color toner by 10 or greater.

13 Claims, 6 Drawing Sheets

(51) Int. Cl.

| | |
|---|---|
| ***G03G 9/087*** | (2006.01) |
| ***G03G 15/01*** | (2006.01) |
| ***G03G 9/08*** | (2006.01) |
| ***G03G 15/00*** | (2006.01) |
| ***G03G 9/09*** | (2006.01) |

(52) U.S. Cl.
CPC ..... *G03G 9/08755* (2013.01); *G03G 9/09* (2013.01); *G03G 9/0926* (2013.01); *G03G 15/0121* (2013.01); *G03G 15/0822* (2013.01); *G03G 15/6585* (2013.01)

(56) References Cited

U.S. PATENT DOCUMENTS

| | | | | |
|---|---|---|---|---|
| 2006/0127791 | A1 | 6/2006 | Rohde et al. | |
| 2008/0166650 | A1* | 7/2008 | Hasegawa | C09D 11/037 430/108.21 |
| 2010/0196817 | A1* | 8/2010 | Sasaki | G03G 9/0819 430/109.4 |
| 2012/0156604 | A1 | 6/2012 | Fukatsu et al. | |
| 2015/0010337 | A1* | 1/2015 | Morinaga | G03G 15/2017 399/341 |
| 2015/0030819 | A1 | 1/2015 | Naito et al. | |

FOREIGN PATENT DOCUMENTS

| | | | | | |
|---|---|---|---|---|---|
| JP | 2732342 | B2 | | 12/1997 | |
| JP | 2732343 | B2 | | 12/1997 | |
| JP | 2001-265181 | A | | 9/2001 | |
| JP | 2001-294785 | A | | 10/2001 | |
| JP | 2002-146254 | A | | 5/2002 | |
| JP | 3550705 | B2 | | 5/2004 | |
| JP | 3835842 | B2 | | 8/2006 | |
| JP | 3882609 | B2 | | 11/2006 | |
| JP | 2007-3944 | A | | 1/2007 | |
| JP | 2007-171508 | A | | 7/2007 | |
| JP | 4026865 | B2 | | 10/2007 | |
| JP | 2010-113368 | A | | 5/2010 | |
| JP | 4715691 | B2 | | 4/2011 | |
| JP | 2015-43069 | A | | 3/2015 | |
| JP | 2018-60169 | A | | 4/2018 | |
| WO | WO 2005/019941 | | * | 3/2005 | G03G 9/09 |
| WO | WO 2005/019941 | A1 | | 3/2005 | |

OTHER PUBLICATIONS

International Search Report dated Nov. 15, 2017 for counterpart International Patent Application No. PCT/JP2017/034373 filed Sep. 22, 2017.

Written Opinion dated Nov. 15, 2017 for counterpart International Patent Application No. PCT/JP2017/034373 filed Sep. 22, 2017.

* cited by examiner

[Fig. 1]
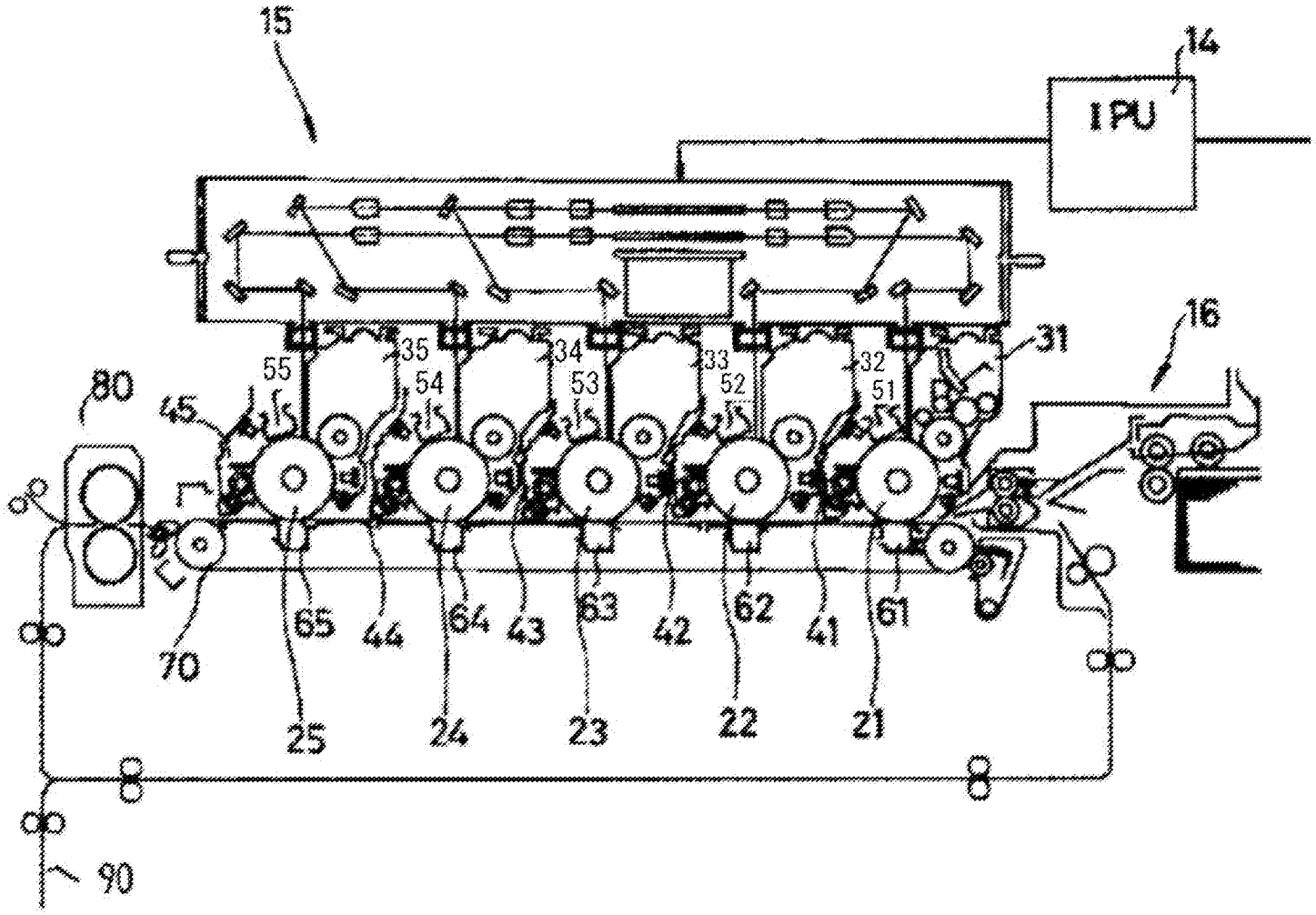

[Fig. 2]
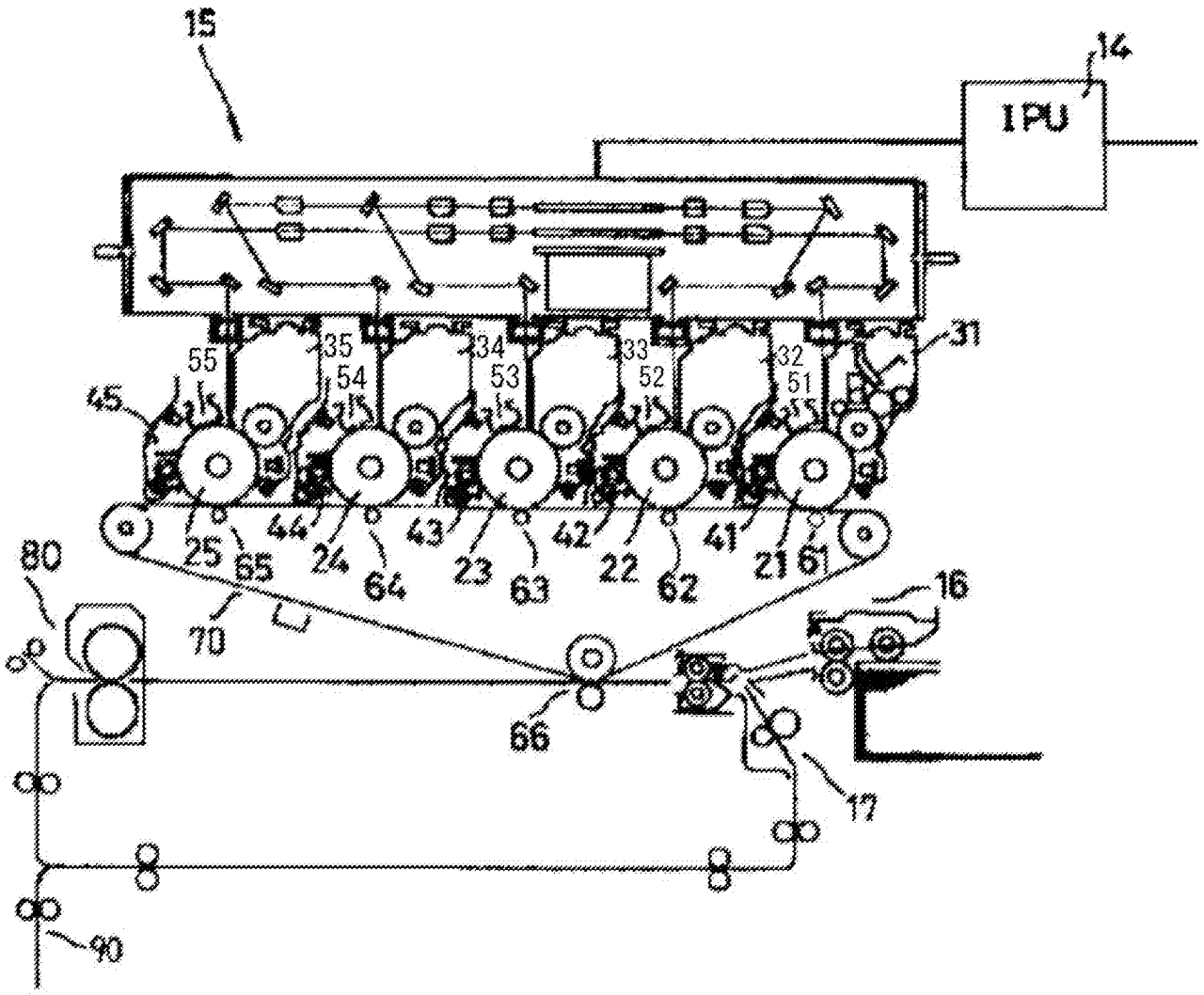

[Fig. 3]
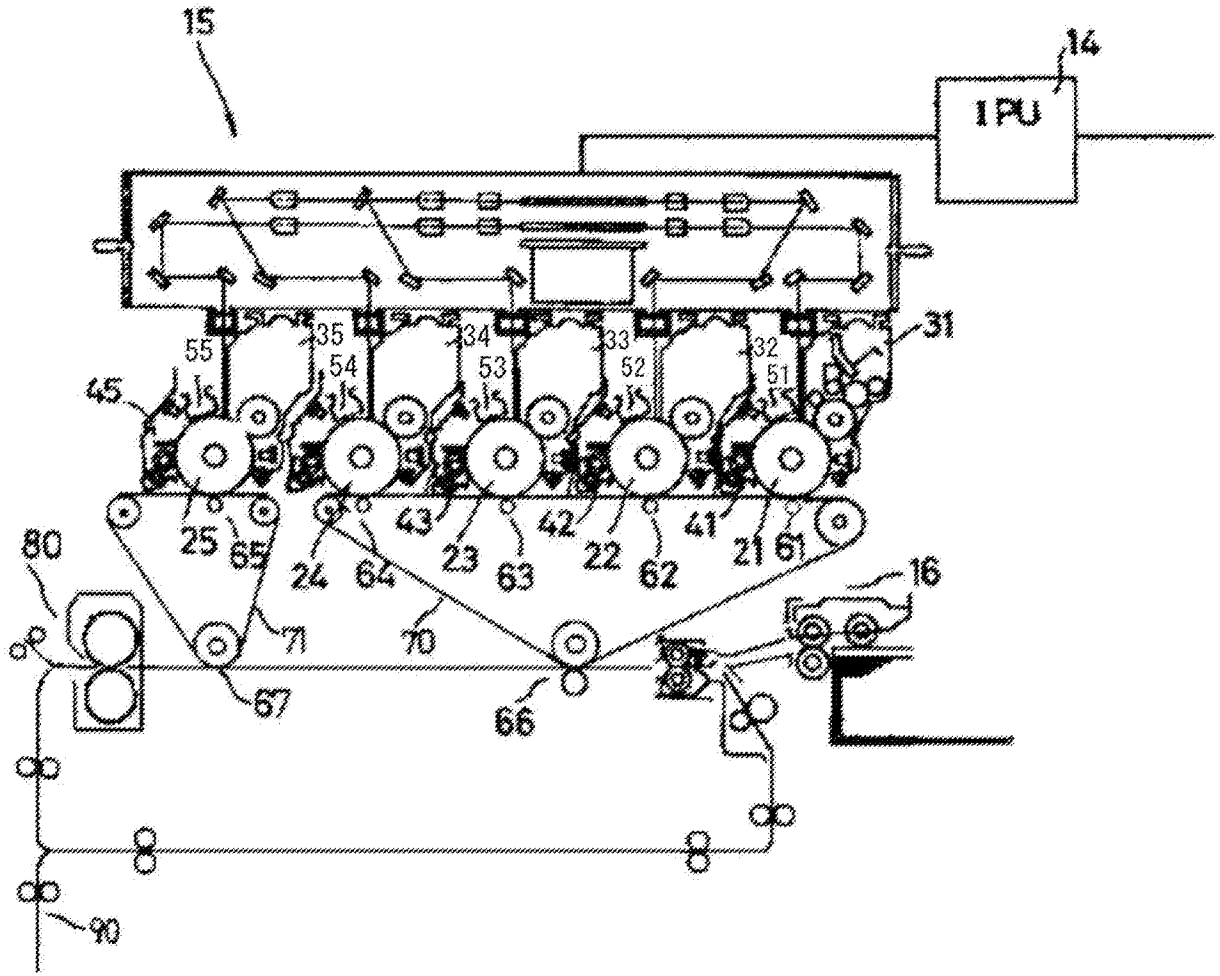
[Fig. 4]
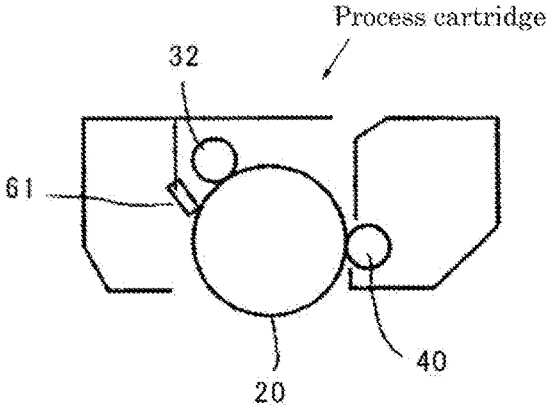

[Fig. 5]
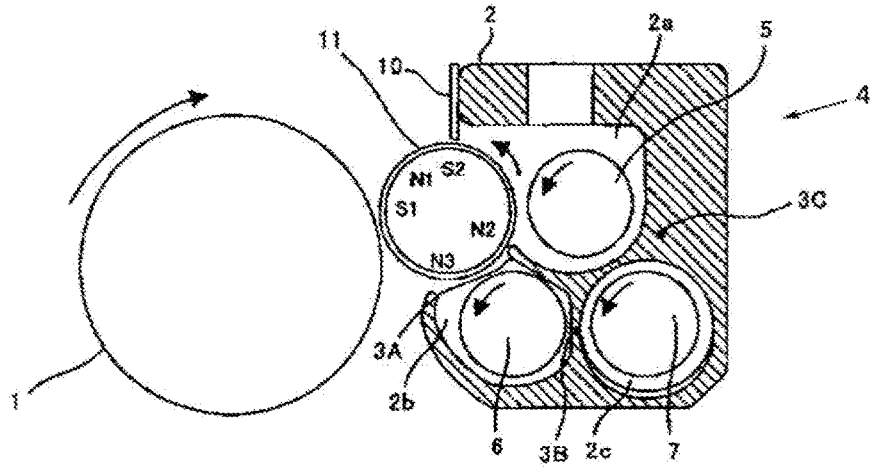
[Fig. 6]
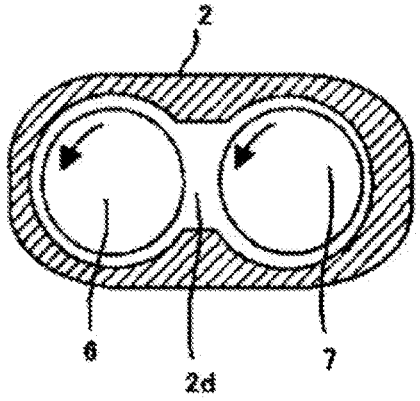
[Fig. 7]
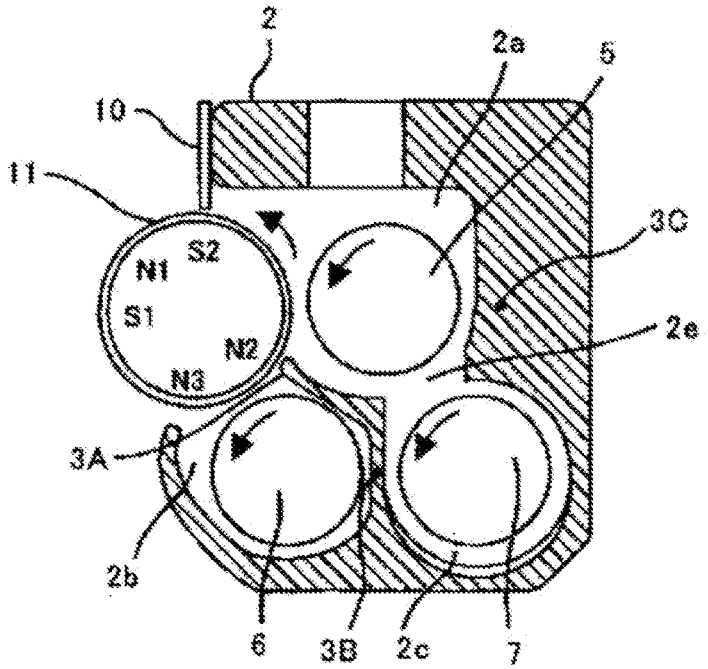

[Fig. 8]
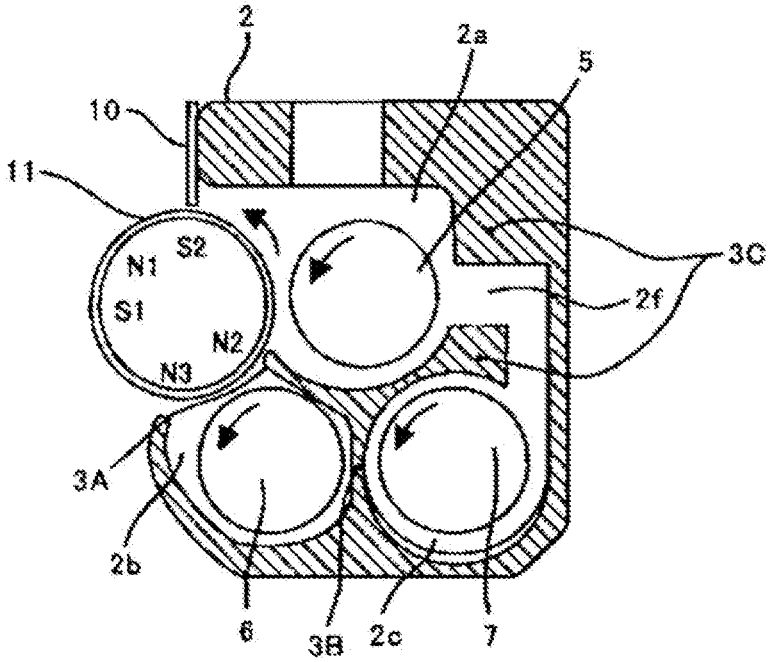
[Fig. 9]
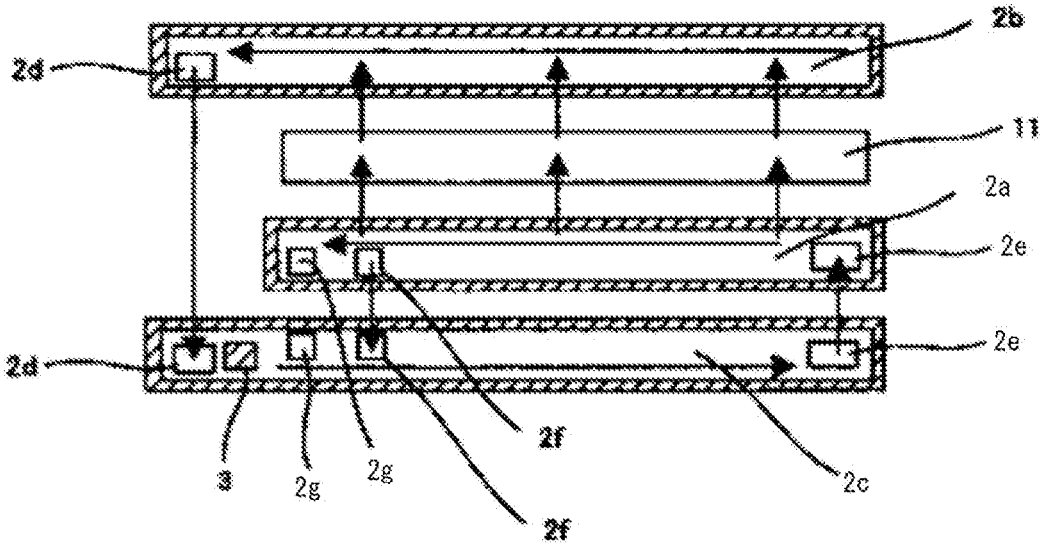

[Fig. 10]
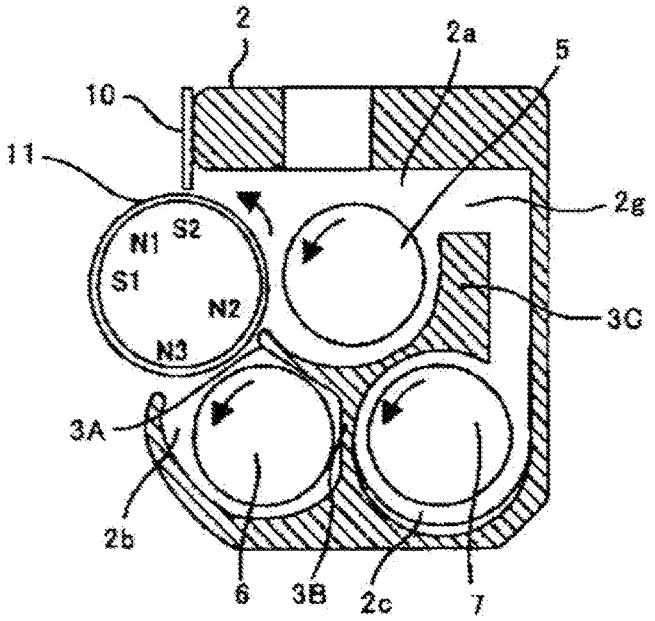
[Fig. 11A]
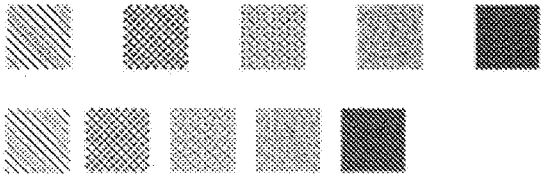
[Fig. 11B]
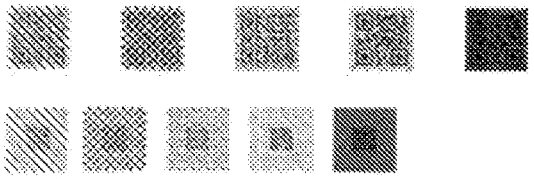
[Fig. 12]
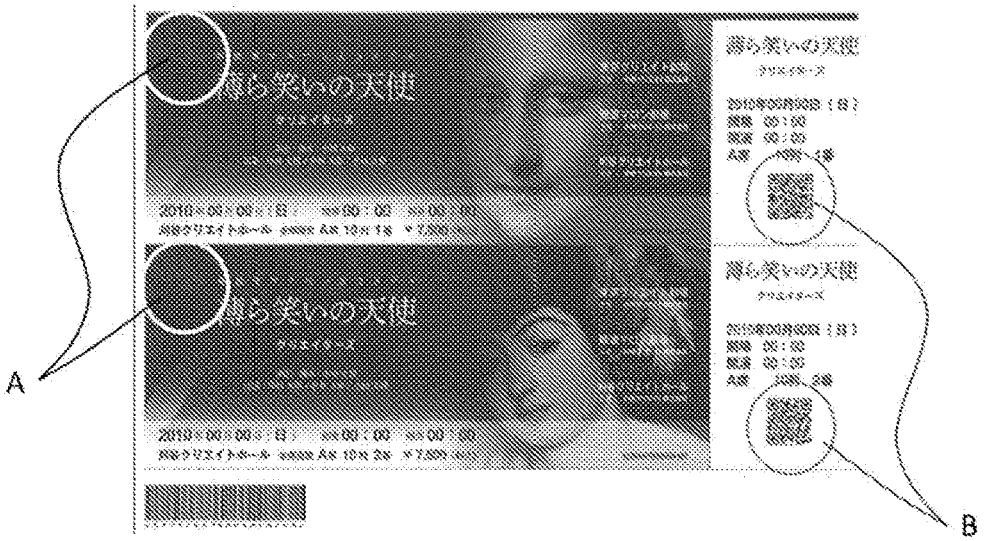

TONER SET, IMAGE FORMING METHOD, AND IMAGE FORMING APPARATUS

TECHNICAL FIELD

The present disclosure relates to a toner set, an image forming method, and an image forming apparatus.

BACKGROUND ART

Hitherto, there is an additional data-embedding technology where additional information is superimposed in an image to embed the information. Recently, use of the additional data-embedding technology in protection of copy rights (e.g., prevention of illegal copy) of digital works, such as a still image has been actively performed. As one example of the use of the additional data-embedding technology, there is a technology where a so-called invisible pattern which is an image that is difficult to visually recognize is formed on a recording medium together with a digital work, when the digital work is photocopied by an image forming apparatus, to thereby embed information related to the image forming apparatus.

As a method for reading the invisible pattern, infrared ray absorption has been used. For example, proposed is that an image formed with a general color toner and an image formed with a colorless toner including an infrared ray-absorbing material (may be referred to as an "invisible toner") are formed parallel or with being superimposed, and images are recorded in a manner that the two image regions are substantially impossible to distinguish or difficult to distinguish with naked eyes (see, for example, PTL 1).

Moreover, proposed is that, when glossiness of an invisible toner is made lower than glossiness of a color toner and a color toner image formed in the same region to an invisible toner image on a surface of an image output medium is visually observed, information can be recorded with high density in the invisible toner without impairing image quality of the color toner image, and the invisible toner image with which mechanical reading and a decoding process by infrared light irradiation is performed stably over a long period can be obtained (see, for example, PTL 2, PTL 8, and PTL 4).

CITATION LIST

Patent Literature

[PTL 1] Japanese Unexamined Patent Application Publication No. 2001-265181

[PTL 2] Japanese Unexamined Patent Application Publication No. 2007-171608

[PTL 3] Japanese Unexamined Patent Application Publication No. 2007-3944

[PTL 4] Japanese Unexamined Patent Application Publication No. 2010-113368

SUMMARY OF INVENTION

Technical Problem

The present disclosure has an object to provide a toner set which achieves excellent visibility of image quality of a color toner image and excellent reading accuracy of an invisible toner image when the invisible toner image formed together with the color toner image on a surface of an image output medium are visually observed.

Solution to Problem

According to one aspect of the present disclosure, a toner set includes a color toner including a binder resin and a colorant, and an invisible toner including a binder resin and a near infrared light-absorbing material. Sixty-degree glossiness of a solid image of the invisible toner is 30 or greater. The 60-degree glossiness of the solid image of the invisible toner is higher than 60-degree glossiness of a solid image of the color toner by 10 or greater.

Advantageous Effects of Invention

The present disclosure can provide a toner set which gives excellent visibility of an image quality of a color toner image and excellent readability of an invisible toner image when the color toner image is output together with the invisible toner image on a surface of an image output medium and the color toner image and the invisible toner image are visually observed.

BRIEF DESCRIPTION OF DRAWINGS

FIG. 1 is a schematic view illustrating one example of an image forming apparatus of the present disclosure.

FIG. 2 is a schematic view illustrating one example of the image forming apparatus of the present disclosure.

FIG. 3 is a schematic view illustrating one example of the image forming apparatus of the present disclosure.

FIG. 4 is a schematic view illustrating one example of a process cartridge of the present disclosure.

FIG. 5 is a cross-sectional view illustrating one example of a schematic structure of a developing device in an image forming apparatus.

FIG. 6 is a cross-sectional view illustrating a collection conveyance channel and stirring conveyance channel in a downstream part relative to a conveyance direction of the collection conveyance channel in one example of an image forming apparatus.

FIG. 7 is a cross-sectional view illustrating an upstream part of a conveyance direction of a supply conveyance channel in one example of an image forming apparatus.

FIG. 8 is a cross-sectional view illustrating a downstream part of a conveyance direction of a supply conveyance channel in one example of an image forming apparatus.

FIG. 9 is a schematic view illustrating a flow of a developer within a developing device in one example of an image forming apparatus.

FIG. 10 is a cross-sectional view of the most downstream part of the conveyance direction of the supply conveyance channel of the developing device.

FIG. 11A is a photograph depicting only color toner images output in Examples.

FIG. 11B is a photograph depicting superimposed invisible toner images and color toner images output in Examples.

FIG. 12 is a photograph depicting superimposed invisible toner images and color toner images output in Examples.

DESCRIPTION OF EMBODIMENTS (Toner Set)

A toner set of the present disclosure is a toner set including a color toner and an invisible toner.

The color toner includes a binder resin and a colorant. The color toner may further include other ingredients according to the necessity.

The invisible toner includes a binder resin and a near infrared light-absorbing material. The invisible toner may further include other ingredients according to the necessity.

In the present disclosure, a toner set with which visibility of image quality of a color toner image and reading accuracy of an invisible toner image are excellent when a color toner image provided together with an invisible toner image on a surface of an image output medium is visually observed can be provided, when the toner set satisfies any of the following items.

One aspect of the toner set of the present disclosure includes the color toner and the invisible toner, where 60-degree glossiness of a solid image of the invisible toner is 80 or greater and the 60-degree glossiness of the solid image of the invisible toner is higher by 10 or greater than 60-glossiness of a solid image of the color toner.

Another aspect of the toner set of the present disclosure includes the color toner and the invisible toner, where loss tangent (tan δi) of the invisible toner at 100 degrees Celsius through 140 degrees Celsius is 2.5 or greater and loss tangent (tan δc) of the color toner at 100 degrees Celsius through 140 degrees Celsius is 2 or less.

The invention disclosed in Japanese Unexamined Patent Application Publication No. 2001-265181 has a problem that an invisible image becomes visible due to a difference in glossiness between superimposed images, because there is no specification associated with a toner image to superimpose. In order to solve the problem just mentioned, use of an invisible toner having lower glossiness than glossiness of a color toner used is proposed in Japanese Unexamined Patent Application Publication Nos. 2007-171508, 2007-003944, and 2010-113368. However, there is the higher demand for image output in recent electrophotographic systems to output an image of relatively low gloss rather than differentiation with an image of high gloss, such as in general offset printing. In a case where color toners have high gloss, therefore, there is a problem that, compared to a base, gloss of an image of secondary color or tertiary color becomes high in a highly deposited area, such as a superimposed area with an invisible image, and a location of the invisible image becomes visually significant. When an image of a color toner is formed on an invisible image, moreover, the color toner laminated on the invisible toner layer tends to penetrate into the invisible toner layer at the time of heating and pressing at a fixing nip, and therefore a resultant image is unstable when information of the invisible image is read by a machine.

<Invisible Toner>

The invisible toner includes a binder resin and a near infrared light-absorbing material. The invisible toner may further include other ingredients according to the necessity.

<<Binder Resin>>

The binder resin is not particularly limited. Any of resins known in the art can be used as the binder resin. Examples of the binder resin include styrene-based resins (e.g., styrene, α-methyl styrene, chlorostyrene, styrene-propylene copolymers, styrene-butadiene copolymers, styrene-vinyl chloride copolymers, styrene-vinyl acetate copolymers, styrene-maleic acid copolymers, styrene-acrylic acid ester copolymers, styrene-methacrylic acid ester copolymers, and styrene-acrylonitrile-acrylic acid ester copolymers), polyester resins, vinyl chloride resins, rosin-modified maleic acid resins, phenol resins, epoxy resins, polyethylene resins, polypropylene resins, ionomer resins, polyurethane resins, silicone resins, ketone resins, xylene resins, petroleum-based resins, and hydrogenated petroleum-based resins. The above-listed examples may be used alone or in combination. Among the above-listed examples, a styrene-based resin including an aromatic compound as a constitutional unit and a polyester resin are preferable, and a polyester resin is more preferable.

The polyester resin is obtained through a polycondensation reaction between general alcohol and acid known in the art.

Examples of the alcohol include: diols, such as polyethylene glycol, diethylene glycol, triethylene glycol, 1,2-propyleneglycol, 1,3-propyleneglycol, 1,4-propyleneglycol, neopentyl glycol, and 1,4-butenediol; etherified bisphenols, such as 1,4-bis(hydroxymethyl)cyclohexane, bisphenol A, hydrogenated bisphenol A, polyoxyethylene bisphenol A, and polyoxypropylene bisphenol A; bivalent alcohol monomers obtained by substituting the above-listed diols with a saturated or unsaturated hydrocarbon group having 8 through 22 carbon atoms; other bivalent alcohol monomers; and trivalent or higher alcohol monomers, such as sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylol ethane, trimethylol propane, and 1,3,5-trihydroxymethylbenzene. The above-listed examples may be used to alone or in combination.

The acid is not particularly limited and may be appropriately selected depending on the intended purpose. The acid is preferably carboxylic acid.

Examples of the carboxylic acid include: monocarboxylic acids, such as palmitic acid, stearic acid, and oleic acid; bivalent organic acid monomers, such as maleic acid, fumaric acid, mesaconic acid, citraconic acid, terephthalic acid, cyclohexane dicarboxylic acid, succinic acid, adipic acid, sebacic acid, malonic acid, and bivalent organic acid monomers obtained by substituting the above-listed monomers with a saturated or unsaturated hydrocarbon group having 3 through 22 carbon atoms; anhydrides of the above-listed acids; dimers of lower alkyl ester and linoleic acid; and trivalent or higher multivalent carboxylic acid monomers, such as 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, and Empol trimer acid, and anhydrides of the above-listed monomers. The above-listed examples may be used alone or in combination.

Note that, the binder resin may further include a crystalline resin.

The crystalline resin is not particularly limited and may be appropriately selected depending on the intended purpose, as long as the crystalline resin is a resin having crystallinity. Examples of the crystalline resin include polyester resins, polyurethane resins, polyurea resins, polyamide resins, polyether resins, vinyl resins, and modified crystalline resins.

The above-listed examples may be used alone or in combination. Among the above-listed examples, a polyester resin, a polyurethane resin, a polyurea resin, a polyamide resin, and a polyether resin are preferable.

In order to give moisture resistance and incompatibility to an amorphous resin described below, a resin having a urethane skeleton, or a urea skeleton, or both is preferable.

In view of fixing ability of a resultant toner, a weight average molecular weight (Mw) of the crystalline resin is preferably from 2,000 through 100,000, more preferably from 5,000 through 60,000, and particularly preferably from 8,000 through 30,000. When the weight average molecular weight is 2,000 or greater, a problem associated with deterioration of hot offset resistance can be prevented. When the weight average molecular weight is 100,000 or less, a problem associated with deterioration of low-temperature fixing ability can be prevented.

<<Near Infrared Light-Absorbing Material>>

As the near infrared light-absorbing material, both an inorganic material-based near infrared light-absorbing material and an organic material-based near infrared light-absorbing material can be used. Various researches have been performed on invisible infrared-absorbing to materials for the technology of embedding additional data and various materials have been disclosed. As the inorganic material-based near infrared light-absorbing material, for example, rare earth metals such as ytterbium (Japanese Unexamined Patent Application Publication No. 09-77507 and Japanese Unexamined Patent Application Publication No. 09-104857) and an infrared-absorbing material including copper phosphate crystal glass (Japanese Unexamined Patent Application Publication No. 07-583945 and Japanese Unexamined Patent Application Publication No. 2008-186238) are listed. As the organic material-based near infrared light-absorbing material, for example, an aluminium compound (Japanese Unexamined Patent Application Publication No. 07-271081) and a croconium dye (Japanese Unexamined Patent Application Publication No. 2001-294785) are listed. In Japanese Unexamined Patent Application Publication No. 2002-146254, moreover, proposed is an organic material including an infrared-absorbing material having a spectral absorption maximum wavelength at from 750 nm through 1,100 nm, where an absorbance of the infrared-absorbing material at 650 nm is 5% or less relative to the absorbance at the spectral absorption maximum wavelength. In Japanese Unexamined Patent Application Publication No. 2007-171508, Japanese Unexamined Patent Application Publication No. 2007-3944, Japanese Unexamined Patent Application Publication No. 2010-113368, and Japanese Unexamined Patent Application Publication No. 2008-76663, moreover, use of a naphthalocyanine pigment is proposed, which is an excellent technique in view of a difference between an absorbance of visible light and an absorbance of light in an infrared range.

Examples of the inorganic material-based near infrared light-absorbing material include: glass in which a material, such as dyes formed of inorganic and/or organic compounds, is added to a known glass-network forming component that passes through wavelengths in a visible range, such as phosphoric acid, silica, and boric acid; and crystalline glass where the above-listed glass is crystallized by a heat treatment. The above-mentioned inorganic materials reflect light of the visible range well and therefore an invisible image can be obtained.

Examples of the organic material-based near infrared light-absorbing material include: color materials, such as phthalocyanine-based compounds and anthoraquinone-based compounds; and colorless materials, such as aluminium salt-based compounds and naphthalocyanine-based compounds. Among the above-listed examples, colorless materials are preferable because an image is not tinted with addition of the near infrared light-absorbing material, absorption of an infrared light range is sufficiently large to thereby minimize an addition amount, and as a result, image quality of a color image is not impaired. Among the colorless materials, naphthalocyanine-based compounds are preferable because absorbance of a visible light range is extremely low, and the naphthalocyanine-based compounds are close to colorless and hardly affect charging of a resultant toner.

The naphthalocyanine-based compound is not particularly limited and may be appropriately selected depending on the intended purpose. As the naphthalocyanine-based compound, a compound listed below is preferable.

[Chem.1]

Formula (1)

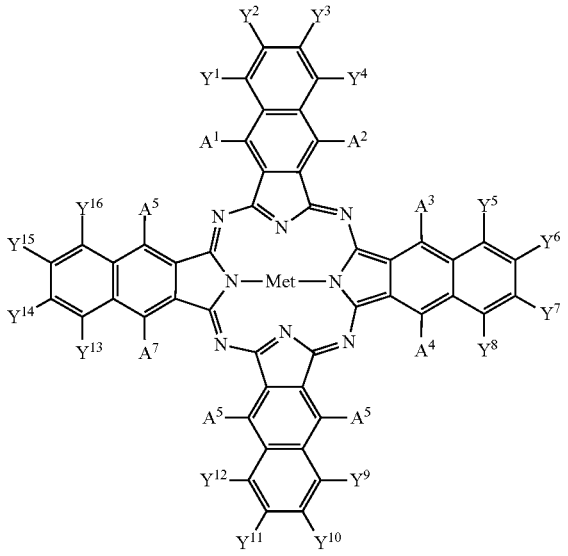

In Formula (1), Met is two hydrogen atoms, a bivalent metal atom, or a trivalent or tetravalent substituted metal atom; and $A^1$ through $A^8$ may be identical or different and are each a hydrogen atom, a halogen atom, a substituted or unsubstituted alkyl group, a substituted or unsubstituted aryl group, a substituted or unsubstituted alkoxy group, a substituted or unsubstituted aryloxy group, a substituted or unsubstituted alkylthio group, or a substituted or unsubstituted arylthio group, with the proviso that in each combination of $A^1$ and $A^2$, $A^3$ and $A^4$, $A^5$ and $A^6$, and $A^7$ and $A^8$, the both cannot be hydrogen atoms or halogen atoms at the same time; and $Y^1$ through $Y^{16}$ may be identical or different and are each a hydrogen atom, a halogen atom, a substituted or unsubstituted alkyl group, a substituted or unsubstituted aryl group, a substituted or unsubstituted alkoxy group, a substituted or unsubstituted aryloxy group, a substituted or unsubstituted alkylthio group, a substituted or unsubstituted arylthio group, a substituted or unsubstituted alkylamino group, a substituted or unsubstituted dialkylamino group, a substituted or unsubstituted arylamino group, a substituted or unsubstituted diarylamino group, a substituted or unsubstituted alkylarylamino group, a hydroxyl group, a mercapto group, a nitro group, a nitrile group, an oxycarbonyl group, an alkoxycarbonyl group, an aryloxycarbonyl group, an aminocarbonyl group, or a mono- or di-substituted aminocarbonyl group.

A reflectance of a reading light wavelength of the near infrared light-absorbing material is preferably 50% or less considering that mechanical reading is stably performed with infrared light irradiation. When the reflectance is 50% or less, a problem that accuracy of reading is reduced can be prevented.

As a measuring method of the reflectance, for example, an output solid image can be measured by means of a spectrophotometer (e.g., V-660 (available from JASCO Corporation) and eXact (available from X-Rite Inc.)).

The near infrared light-absorbing material is preferably added to the invisible toner by dispersing the near infrared light-absorbing material in toner particles of the invisible toner.

In a case where the near infrared light-absorbing material is externally adhered to surfaces of toner particles or mixed with a group of toner particles, the near infrared light-absorbing material may cause aggregations in toner particles and a developer. Even when an amount of the near infrared light-absorbing material necessary as a bulk is added, some of the near infrared light-absorbing material is lost through deposition onto a device during external adhesion onto surfaces of the toner particles or adjustment of the developer. Therefore, the near infrared light-absorbing material in an invisible image becomes insufficient or is unevenly distributed. As a result, information cannot be read out accurately and stably. Moreover, the separated near infrared light-absorbing material pollutes inside a device, especially a photoconductor etc., and therefore other steps, such as developing and transferring, may be adversely affected. In a case where the above-mentioned organic-based near infrared light-absorbing material is used, the near infrared light-absorbing material has better dispersibility to a binder resin than the inorganic-based material, is homogeneously dispersed in an invisible image formed on an image output medium, does not impair invisibility in a visible range, enables recording of information with high density because of sufficient absorption in an infrared range, and enables stable mechanical reading and decoding process of an invisible image over a long period because of excellent dispersibility in a toner.

A numerical range of an amount of the near infrared light-absorbing material varies depending on properties of the near infrared light-absorbing material. When the amount is an appropriate amount regardless of a type of the near infrared light-absorbing material, the following problems can be prevented.

Problems caused due to an insufficient amount. When the amount of the near infrared light-absorbing material is insufficient, absorption of near infrared light is insufficient, and therefore a large amount of the invisible toner needs to be deposited on a medium such as paper. As a result, there are problems that visually recognizable surface irregularities are caused by aggregates (bulks) of the invisible toner as well as wasting resources.

Problems caused due to an excess amount of the near infrared light-absorbing material. Only slightly, but the near infrared light-absorbing material has absorption in a visible light wavelength range. As a result, there is a problem that the near infrared light-absorbing material itself is easily visually recognized.

In case of vanadyl naphthalocyanine that is often used as an invisible near infrared light-absorbing material, an amount of the vanadyl naphthalocyanine is preferably 0.3% by mass or greater but 1.0% by mass or less relative to the invisible toner.

<<Other Ingredients>>

The above-mentioned other ingredients are not particularly limited and may be appropriately selected depending on the intended purpose, as long as the ingredients are ingredients typically contained in a toner. Examples of the above-mentioned other ingredients include a release agent, a charge-controlling agent, and external additives.

<<<Release Agent>>>

As the release agent, any of natural wax and synthetic wax can be used. The natural wax and synthetic wax may be used alone or in combination as the release agent.

Examples of the natural wax include: vegetable wax, such as carnauba wax, cotton wax, Japan wax, and rice wax; animal wax, such as bees wax and lanolin; mineral wax such as ozokelite and ceresin; and petroleum wax, such as paraffin, microcrystalline wax, and petrolatum.

Examples of synthetic wax include: synthetic hydrocarbon wax, such as Fischer-Tropsch and polyethylene wax; synthetic wax, such as ester wax, ketone wax, and ether wax; fatty acid amide, such as 1,2-hydroxystearic acid amide, stearic acid amide, phthalic anhydride imide, and chlorinated hydrocarbon; and a crystalline polymer having a long alkyl group at a side chain, such as a homopolymer or copolymer (e.g., a n-stearyl acrylate-ethyl methacrylate copolymer) of polyacrylate (e.g., n-stearyl polymethacrylate and n-lauryl polymetacrylate) that is a low-molecular weight crystalline polymer.

Among the above-listed examples, the release agent preferably include monoester wax. Since the monoester wax has low compatibility to a typical binder resin, the monoester wax tends to bleed out to a surface of the toner particle at the time of fixing to exhibit high lubricity, and therefore high gloss and excellent low-temperature fixing ability can be assured.

The monoester wax is preferably synthetic ester wax. Examples of the synthetic ester wax include monoester wax synthesized from long-straight-chain saturated fatty acid and long-straight-chain saturated alcohol. The long-straight-chain saturated fatty acid is represented by a general formula: $C_nH_{2n+1}COOH$, where n is preferably from about 5 through about 28. Moreover, the long-straight-chain saturated alcohol is represented by a general formula: $C_nH_{2n+1}OH$, where n is preferably from about 5 through about 28.

Specific examples of the long-straight-chain saturated fatty acid include capric acid, undecylic acid, lauric acid, tridecylic acid, myristic acid, pentadecylic acid, palmitic acid, heptadecanoic acid, tetradecanoic acid, stearic acid, nonadecanoic acid, aramonic acid, behenic acid, lignoceric acid, cerotic acid, heptacosanoic acid, montanic acid, and melissic acid. Specific examples of the long-straight-chain saturated alcohol include amyl alcohol, hexyl alcohol, heptyl alcohol, octyl alcohol, capryl alcohol, nonyl alcohol, decyl alcohol, undecyl alcohol, lauryl alcohol, tridecyl alcohol, myristyl alcohol, pentadecyl alcohol, cetyl alcohol, heptadecyl alcohol, stearyl alcohol, nonadecyl alcohol, eicosyl alcohol, ceryl alcohol, and heptadecanol, where the above-listed examples may have a substituent, such as a lower alkyl group, an amino group, and a halogen group.

A melting point of the release agent is preferably from 50 degrees Celsius through 120 degrees Celsius. When the melting point of the release agent is within the above-mentioned numerical range, the release agent can effectively function as a release agent at an interface between a fixing roller and a toner, and therefore high-temperature offset resistance can be improved without applying a release agent, such as oil, to the fixing roller. Specifically, a problem of deterioration of heat resistant storage stability of the toner can be prevented when the melting point of the release agent is 50 degrees Celsius or higher, and a problem that release properties are not exhibited at low temperatures to deteriorate cold offset resistance and to cause wrapping of sheets around a fixing device can be prevented when the melting point of the release agent is 120 degrees Celsius or lower. For example, a measurement of a melting point of the release agent can be performed by measuring a maximum endothermic peak by means of TG-DSC System TAS-100 (available from Rigaku Corporation) that is differential scanning calorimeter.

An amount of the release agent is preferably from 1% by mass through 20% by mass and more preferably from 8% by mass through 10% by mass relative to the binder resin. When the amount is 1% by mass or greater, a problem that an anti-offset effect is insufficient can be prevented.

When the amount is 20% by mass or less, a problem that transfer property and durability of the toner are deteriorated can be prevented.

Moreover, an amount of the monoester wax is preferably from 4 parts by mass through 8 parts by mass and more preferably from 5 parts by mass through 7 parts by mass relative to 100 parts by mass of the invisible toner. When the amount is 4 parts by mass or greater, problems that bleeding of the wax to a surface of a toner particle is insufficient during fixing, release properties are poor, and gloss, low-temperature fixing ability, and high-temperature offset resistance are deteriorated can be prevented. When the amount is 8 parts by mass or less, problems that an amount of the release agent precipitate on a surface of a toner particle increases to deteriorate storage stability of a toner and antifilming properties to a photoconductor etc. is deteriorated can be prevented.

The toner of the present disclosure preferably includes a wax dispersing agent. The dispersing agent is preferably a copolymer composition including as a monomer at least styrene, butyl acrylate and acrylonitrile, or a polyethylene adduct of the copolymer composition.

An amount of the wax dispersing agent is preferably 7 parts by mass or less relative to 100 parts by mass of the invisible toner. Use of the wax dispersing agent in the toner can give an effect of dispersing wax and can expect an improvement of stable storage stability without affected by a production method. Moreover, diameters of dispersed wax elements are small owing to the effect of dispersing wax to inhibit filming of the wax to a photoconductor etc. When the amount is 7 parts by mass or less, the following problems can be prevented. Specifically, a proportion of an incompatible component to the polyester resin increases to reduce gloss, and dispersibility of the wax becomes too high and hence antifilming properties are improved but bleeding of the wax to a surface of a toner particle during fixing is poor to thereby deteriorate low-temperature fixing ability and hot offset resistance.

<<<Charge-Controlling Agent>>>

As the charge-controlling agent, any of charge-controlling agents known in the art can be used. Examples of the charge-controlling agent include nigrosine-based dyes, triphenylmethane-based dyes, chrome-containing metal complex dyes, molybdic acid chelate pigments, rhodamine-based dyes, alkoxy-based amine, quaternary ammonium salts (including fluorine-modified quaternary ammonium salts), alkyl amide, phosphorous along or phosphorous compounds, fluorine-based active agents, salicylic acid metal salts, and metal salts of salicylic acid derivatives. The above-listed examples may be used alone or in combination.

As the charge-controlling agent, an appropriately synthesized charge-controlling agent may be used or a commercial product may be used. Examples of the commercial product include: BONTRON 03, BONTRON P-51, BONTRON S-34, E-82, E-84, and E-89 (all available from ORIENT CHEMICAL INDUSTRIES CO., LTD.); TP-302, TP-415, COPY CHARGE PSY VP2038, COPY BLUE PR, COPY CHARGE NEG VP2036, and COPY CHARGE NX VP484 (all available from Hoechst AG); and LRA-901 and LR-147 (both available from Japan Carlit Co., Ltd.).

An amount of the charge-controlling agent may be appropriately selected depending on a binder resin for use, presence of additives optionally used, and a toner production method including a dispersing method. The amount of the charge-controlling agent is preferably from 0.1 parts by mass through 5 parts by mass and more preferably from 0.2 parts by mass through 2 parts by mass relative to 100 parts by mass of the binder resin. When the amount is 5 parts by mass or less, the following problems can be prevented. The problems are that charging ability of a resultant toner is too large to lower an effect of a main charge-controlling agent, and therefore electrostatic attraction of the toner with a developing roller increases to lower flowability of a developer or lower image density.

Moreover, use of a trivalent or higher metal salt among charge-controlling agents enables to control thermal properties of a resultant toner. Since the metal salt is included in the toner, a cross-linking reaction with an acid group of a binder resin progresses during fixing to form a weak three-dimensional crosslink, and therefore hot offset resistance can be obtained with maintaining low-temperature fixing ability.

Examples of the metal salt include metal salts of salicylic acid derivative and acetylacetonate metal salts. The metal is not particularly limited and may be appropriately selected depending on the intended purpose, as long as the metal is trivalent or higher multivalent ionic metal.

Examples of the metal include iron, zirconium, aluminium, titanium, and nickel. Among the above-listed examples, a trivalent or higher cyclic acid metal compound is preferable.

An amount of the metal salt is not particularly limited and may be appropriately selected depending on the intended purpose. For example, the amount is preferably from 0.5 parts by mass through 2 parts by mass and more preferably from 0.6 parts by mass through 1 part by mass relative to 100 parts by mass of the invisible toner. When the amount is 0.5 parts by mass or greater, a problem that hot offset resistance becomes poor can be prevented. When the amount is 2 parts by mass or less, a problem of poor glossiness can be prevented.

<<<External Additives>>>

The external additives are added to the toner in order to aid flowability, developing ability, and charging ability of the toner. The external additives are not particularly limited and may be appropriately selected depending on the intended purpose. Examples of the external additives include inorganic particles and polymer-based particles.

Examples of the inorganic particles include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. The above-listed examples may be used alone or in combination. Examples of the polymer-based particles include polymer particles of a polycondensation-based resin or thermoset resin obtained by soap-free emulsion polymerization, suspension polymerization, or dispersion polymerization, such as polystyrene, methacrylic acid ester copolymers, acrylic acid ester copolymers, silicone, benzoguanamine, and nylon.

The external additives may be subjected to a surface treatment with the surface-treatment agent to enhance hydrophobicity to thereby prevent deterioration of flowability or charging properties in a high humidity environment.

Examples of the surface-treatment agent include silane-coupling agents, silylating agents, silane-coupling agents including alkyl fluoride groups, organic titanate-based coupling agents, aluminium-based coupling agent, silicone oil, and modified silicone oil.

A primary particle diameter of the external additives is preferably from 5 nm through 2 micrometers and more preferably from 5 nm through 500 nm. Moreover, a specific surface area of the external additive according to the BET method is preferably from 20 $m^2/g$ through 600 $m^2/g$. An amount of the external additives is preferably from 0.01% by mass through 5% by mass and more preferably from 0.01% by mass through 2.0% by mass relative to the invisible toner.

<<<Cleaning Improver>>>

The cleaning improver is added to the toner to remove a developer remained on a photoconductor or a primary transfer medium after transfer. Examples of the cleaning improver include: fatty acid (e.g., stearic acid) metal salts, such as zinc stearate and calcium stearate; and polymer particles produced by soap-free emulsion polymerization, such as polymethyl methacrylate particles and polystyrene particles. The polymer particles are preferably polymer particles having a relatively narrow particle-size distribution and having a volume average particle diameter of from 0.01 micrometers through 1 micrometer.

<Color Toner>

The color toner includes a binder resin and a colorant. The color toner may further include other ingredients according to the necessity. As the above-mentioned other ingredients, the same ingredients to the ingredients described as the other ingredients in the invisible toner can be used.

The color toner is preferably a cyan toner, a magenta toner, a yellow toner, or a black toner. The color toner is more preferably a combination of a cyan toner, a magenta toner, a yellow toner, and a black toner.

In other words, in the toner set, 60-degree glossiness of a solid image of the invisible toner is preferably higher than 60-degree glossiness of a solid image of a cyan toner, a magenta toner, a yellow toner, or a black toner by or greater, and is more preferably higher than 60-degree glossiness of all of solid images of a cyan toner, a magenta toner, a yellow toner, and a black toner by 10 or greater.

<<Binder Resin>>

A toner image formed with the color toner of the present disclosure preferably has low gloss compared to an image formed by typical offset printing.

Therefore, the binder resin included in the color toner is not particularly limited and may be appropriately selected depending on the intended purpose, but the binder resin preferably includes a gel. The gel fraction relative to the binder resin is preferably 0.5% by mass or greater but 20% by mass or less, and more preferably 1.0% by mass or greater but 10% by mass or less.

Even in a case where the gel is not included, the binder resin used for the color toner preferably includes a polymer having a weight average molecular weight Mwc of 100,000 or greater. The weight average molecular weight Mwc of the polymer included is more preferably larger than a weight average molecular weight Mwi of the binder resin used for the invisible toner. Gloss of a color image having high visibility compared to offset printing and having 60-degree glossiness of from about through about 80 can be obtained by making a weight average molecular weight Mwc of the binder resin used in the color toner larger than a weight average molecular weight Mwi of the binder resin used in the invisible toner.

<<Colorant>>

The colorant is preferably a colorant having small absorbance at a wavelength of 800 nm or longer. Examples of the colorant include naphthol yellow S, Hansa yellow (10G, 5G, G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazine lake, quinoline yellow lake, anthrasan yellow BGL, isoindolinon yellow, red iron oxide, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F6R, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS, BC), indigo, dioxane violet, anthraquinone violet, chrome green, zinc green, viridian, emerald green, pigment green B, naphthol green B, green gold, acid green lake, malachite green lake, phthalocyanine green, anthraquinone green, titanium oxide, zinc flower, lithopone, perylene black, perinone black, and a mixture of any of the above-listed colorants. The above-listed examples may be used alone or in combination.

In a case where toners are used as process color toners, each of black, cyan, magenta, and yellow is preferably a colorant below.

The black is preferably perylene black or perinone black. The cyan is preferably C.I. Pigment Blue 15:8. The magenta is preferably C.I. Pigment Red 122, C.I. Pigment Red 269, or C.I. Pigment Red 81:4. The yellow is preferably C.I. Pigment Yellow 74, C.I. Pigment Yellow 1556, C.I. Pigment Yellow 180, or C.I. Pigment Yellow 185. The above-mentioned colorants may be used alone or in combination.

Note that, use of perylene black including a compound having a perylene structure or perinone black including a compound having a perinone structure is preferably because such a colorant has high pigmentation and can form a black image that permeates infrared rays without being influenced by toner charging properties.

Absorbent of the colorant at 800 nm or longer is preferably less than 0.05 and more preferably less than 0.01. When the absorbance is less than 0.06, a problem that the color toner inhibits reading of information formed with the invisible toner when the color toner is superimposed on the invisible toner can be prevented.

An amount of the colorant depends on coloring power of each colorant, but the amount is preferably from 38% by mass through 12% by mass and more preferably from 5% by mass through 10% by mass relative to the entire color toner of each color. When the amount is 38% by mass or greater, problems that pigmentation is insufficient and therefore a deposition amount of a single color toner increases to waste resources can be prevented. When the amount is 12% by mass or less, problems that the colorant significantly affects charging ability of a toner and therefore it is difficult to maintain a stable charging amount of the toner can be prevented.

<Properties of Invisible Toner and Color Toner>

The 60-degree glossiness of a solid image of the invisible toner is 30 or greater, preferably 30 or greater but 80 or less, and more preferably 30 or greater but 60 or less. When the 60-degree glossiness of the solid image is less than 80, visibility of the invisible toner image increases and therefore the invisible toner image does not function as an intended hidden image. When the 60-degree glossiness of the solid image is greater than 80, a molecular weight of the toner resin is small and therefore it is difficult to assure a sufficient fixing temperature range. The 60-degree glossiness of a solid image of the color toner is preferably 10 or greater but 40 or less and more preferably 15 or greater but 85 or less. When the glossiness is within the above-mentioned numerical range, a resultant color toner image is an image of relatively low gloss.

Moreover, the 60-degree glossiness of the solid image of the invisible toner is higher than 60-degree glossiness of a solid image of the color toner by 10 or greater, preferably 15 or greater, and more preferably 20 or greater. When a difference between the 60-degree glossiness of the solid image of the invisible toner and the 60-degree glossiness of the solid image of the color toner is less than 10, as the color toner image is superimposed on the invisible toner image on an image output medium at the time of image formation before heat-fixing, the color toner of a top layer penetrates the invisible toner layer of a bottom layer at the time of heat-press fixing to thereby deteriorate visibility of the color toner image. Specifically, visibility of the color toner image superimposed as a top layer improves because the glossiness of the solid image of the invisible toner is higher than the glossiness of the solid image of the color toner, and as a result, the invisible toner image of the bottom layer is hard to be visually recognized.

Absorbance of a solid image of the color toner at 800 nm or longer is preferably less than 0.05 and more preferably less than 0.01.

Examples of a method for adjusting glossiness of solid images of the invisible toner and the color toner include: adjustment of a proportion of a gel in the binder resin; and adjustment of a weight average molecular weight of the binder resin. As the gel fraction of the binder resin increases, glossiness of the toner is lower. As the gel fraction of the binder resin is closer to 0, glossiness of the toner increases. In a case where a binder resin free from a gel is used, glossiness is lower as a weight average molecular weight of the binder resin increases, and glossiness is higher as the weight average molecular weight decreases.

Moreover, gloss can be adjusted by using a resin having an acid value as a binder resin, or adding a trivalent or higher metal salt. As the acid value of the binder resin is higher and an amount of the metal salt added is larger, glossiness tends to be lower. As the acid value is smaller and the amount of the metal salt added is smaller, the glossiness tends to be higher.

A weight average molecular weight (Mwi) of the invisible toner is preferably from 6,000 through 12,000 and more preferably from 7,500 through 10,000.

As the weight average molecular weight, a molecular weight distribution of a THF-soluble component can be measured by gel permeation chromatography (GPC) measuring device GPC-150C (available from WATERS).

For example, a measurement of the weight average molecular weight is performed by the following method using a column (KF801 through 807: available from SHOWA DENKO K.K.).

The column is stabilized in a heat chamber of 40 degrees Celsius and as a solvent, THF is introduced into the column of 40 degrees Celsius at a flow rate of L mL/min. After sufficiently dissolving 0.05 g of a sample in 5 g of THF, the resultant solution is filtered with a filter for pretreatment (e.g., chromatodisc having a pore size of 0.45 micrometers (available from KURABO INDUSTRIES LTD.)) to prepare a THF sample solution of the resin where the sample concentration is adjusted to from 0.05% by mass through 0.6% by mass. The THF sample solution in an amount of from 50 microliters through 200 microliters is injected to perform a measurement.

A gel fraction of the invisible toner is preferably from 0% by mass through 2% by mass.

The gel fraction can be calculated from a dry weight of a component obtained by filtration with the filter for pretreatment used during the measurement of the weight average molecular weight.

A ratio of the weight average molecular weight (Mw)/number average molecular weight (Mn) of the invisible toner is preferably 5 or less and more preferably 4 or less.

As a measuring method of the weight average molecular weight Mw and the number average molecular weight Mn, a molecular weight distribution of the invisible toner is calculated from a relationship between a logarithm and count number of a calibration curve prepared by several monodisperse polystyrene standard samples.

Examples of the standard polystyrene samples for preparing the calibration curve includes samples having molecular weights of $6\times10^2$, $2.1\times10^2$, $4\times10^2$, $1.75\times10^4$, $6.1\times10^4$, $1.1\times10^6$, $8.9\times10^5$, $8.6\times10^6$, $2\times10^6$, and $4.48\times10^8$ (available from Pressure Chemical Company or TOSOH CORPORATION). For a preparation of a calibration curve, use of at least about 10 standard polystyrene samples is appropriate. Moreover, as a detector, a refractive index (RI) detector is used.

An acid value of the invisible toner is preferably 12 mgKOH/g or less and more preferably from 6 mgKOH/g through 12 mgKOH/g. The acid value can be adjusted to the above-mentioned range by using a polyester resin as the binder resin. When the acid value is in the above-mentioned range, both low-temperature fixing ability and hot offset resistance can be easily achieved.

A measurement of the acid value of the toner and the binder resin in the present disclosure is performed according to a measurement method disclosed in JIS K0070-1992 under the following conditions.

A preparation of a sample solution is performed as follows. To 120 mL of toluene, 0.6 g of the toner or the binder resin (0.3 g of an ethyl acetate-soluble component) is added and the resultant is stirred for about hours at room temperature (23 degrees Celsius) to dissolve the toner or the binder resin. To the resultant, 80 mL of ethanol is further added to prepare a sample solution.

As the measurement, the acid value can be calculated by the device mentioned above, but the calculation is performed specifically as follows. The sample is titrated with an N/10 potassium hydroxide alcohol solution that has been standardized in advance. The acid value is determined from the consumed amount of the potassium hydroxide alcohol solution using the following equation.

Acid value=*KOH* (value in mL)×*N*×56.1/mass of sample (with the proviso that *N* is a factor of *N*/10*KOH*)

Note that, an acid value of the binder resin and an acid value of the toner were substantially matched in any of Examples and Comparative Examples below. Accordingly, the acid value of the binder resin is treated as the acid value of the toner.

<<Toner Particle Diameter>>

A weight average particle diameter of the invisible toner is preferably from 6 micrometers through 7 micrometers and more preferably from 6 micrometers through 6 micrometers.

A weight average particle diameter of the color toner is preferably from 4 micrometers through 8 micrometers and more preferably from 6 micrometers through 7 micrometers.

When the weight average particle diameter is within the above-mentioned range, fine dots of 600 dpi or greater can be realized and an image of high image quality can be obtained. The toner having the above-mentioned weight average particle diameter can include toner particles having sufficiently small particle diameters against fine latent image dots and therefore has an advantage that dot-reproducibility is excellent. Particularly with the invisible toner, an image having high reproducibility after fixing can be obtained by disposing the invisible toner image with high density, and preventing the color toner superimposed on the invisible toner from entering gaps between the invisible toner particles in a state that the toners are transferred on an image output medium before fixing. The image having high reproducibility enables a more stable process of mechanical reading with infrared light irradiation.

When a weight average particle diameter (D4) of the color toner is 4 micrometers or greater, phenomena, such as reduction in transfer efficiency and deterioration of a blade cleaning performance can be prevented. When the weight average molecular weight (D4) of the color toner is 8 micrometers or less, problems that image information tends to be disturbed by penetration of the superimposed color toner to an image before fixing as described above and it is difficult to suppress scattering of characters or lines can be prevented.

Moreover, a ratio (D4/D1) of the weight average particle diameter (D4) to a number average particle diameter (D1) is preferably from 1.00 through 1.40 and more preferably from 1.05 through 1.80. The closer value of the ratio (D4/D1) to 1.00 means that a particle size distribution is sharper. The toner having the small particle diameters and narrow particle size distribution as described above has a uniform charging amount distribution of the toner, and therefore an image having high quality with less background deposition can be obtained, and moreover a transfer ratio can be made high in an electrostatic transfer system.

In a full-color image forming method where a multicolor image is formed by superimposing toner images of different colors, an amount of the toner deposited on paper is large compared to a monochromic image forming method where it is not necessary to superimpose toner images of different colors because an image is formed with only a single color of a black toner. Specifically, an amount of the toner used for developing, transferred and fixed increases, and therefore the above-described problems, such as deterioration of transfer efficiency, deterioration of blade cleaning performance, scattering of characters or lines, and deterioration of image quality such as background deposition, tend to occur. Accordingly, it is important to control the weight average particle diameter (D4) and the ratio (D4/D1) of the weight average particle diameter (D4) to the number average particle diameter (D1).

A measurement of the particle size distribution of the toner particles can be performed by means of a measuring device for a particle size distribution of toner particles according to a coulter counter method. Examples of the device include Coulter Counter TA-II and Coulter Multisizer II (both available from Beckman Coulter Inc.).

A specific measurement method is as described below.

First, 0.1 mL through 5 mL of a surfactant (e.g., alkyl benzene sulfonate) serving as a dispersant is added into 100 mL through 150 mL of an electrolytic aqueous solution. The electrolytic aqueous solution is prepared as an about 1% NaCl aqueous solution using grade-1 sodium chloride. Examples of the electrolytic aqueous solution include ISO-TON-II (available from Beckman Coulter, Inc.).

Next, 2 mg through 20 mg of a measurement sample is added to the resultant solution. The electrolytic solution to which the sample is suspended is subjected to a dispersion treatment for about 1 minute through about 3 minutes by means of an ultrasonic wave disperser. The resultant dispersion is provided to the measurement device with an aperture of 100 micrometers to measure a weight and numbers of toner particles or toner to thereby calculate a weight distribution and a number distribution. A weight average particle diameter (D4) and a number average particle diameter (D1) of the toner can be determined from the obtained distributions.

As channels, the following 13 channels are used: 2.00 micrometers or greater but less than 2.52 micrometers; 2.52 micrometers or greater but less than 3.17 micrometers; 8.17 micrometers or greater but less than 4.00 micrometers; 4.00 micrometers or greater but less than 5.04 micrometers; 5.04 micrometers or greater but less than 6.85 micrometers; 6.35 micrometers or greater but less than 8.00 micrometers; 8.00 micrometers or greater but less than 10.08 micrometers; 10.08 micrometers or greater but less than 12.70 micrometers; 12.70 micrometers or greater but less than 16.00 micrometers; 16.00 micrometers or greater but less than 20.20 micrometers; 20.20 micrometers or greater but less than 25.40 micrometers; 25.40 micrometers or greater but less than 82.00 micrometers; and 32.00 micrometers or greater but less than 40.30 micrometers. The target particles for the measurement are particles having the diameters of 2.00 micrometers or greater but less than 40.80 micrometers.

It has been known that loss tangent (tan δ) of a toner for developing electrophotography has clear correlation with glossiness of an image. As a value of the tan δ increases, spreadability of the toner during fixing increases and concealment of a base becomes high and therefore an image of high gloss is obtained.

The loss tangent (tan δi) of the invisible toner at 100 degrees Celsius through 140 degrees Celsius is preferably 2.5 or greater and more preferably 3.0 or greater. The tan δi is preferably 15 or less. Note that, the phrase "the loss tangent (tan δi) of the invisible toner at 100 degrees Celsius through 140 degrees Celsius is preferably 2.5 or greater" means that the loss tangent (tan δi) of the invisible toner is always 2.5 or greater at the temperature of from 100 degrees Celsius through 140 degrees Celsius.

The loss tangent (tan δc) of the color toner at 100 degrees Celsius through 140 degrees Celsius is preferably 2 or less.

The tan δc is preferably 0.1 or greater. When the loss tangent of the color toner is 2 or less, a problem that a color toner superimposed on an invisible image migrates the invisible toner hence stability of the invisible toner image is impaired can be prevented. Note that, the phrase "the loss tangent (tan δc) of the color toner at 100 degrees Celsius through 140 degrees Celsius is 2 or less" means that the loss tangent (tan δc) of the color toner is always 2 or less at the temperature of from 100 degrees Celsius through 140 degrees Celsius.

The loss tangent (tan δ) of the toner for developing in electrophotography is a ratio (G")/(G') of a loss modulus (G") to a storage elastic modulus (G') and can be measured by a viscoelasticity measurement. For example, the loss modulus (G") and the storage elastic modulus (G') can be measured by the following method. The invisible toner or color toner in an amount of 0.8 g is molded at the pressure of 30 MPa using a die having a diameter of 20 mm. Loss modulus (G"), storage elastic modulus (G'), and loss tangent (tan δ) of the resultant sample can be measured by means of ADVANCED RHEOMETRIC EXPANSION SYSTEM (available from TA Instruments) using a parallel corn having a diameter of 20 mm at a frequency of 1.0 Hz, heating speed of 2.0 degrees Celsius/min, strain of 0.1% (automatic strain control, optimum minimum stress: 1.0 g/cm, optimum maximum stress: 500 g/cm, maximum additional strain: 200%, strain adjustment: 200%), and with GAP with which force after setting the sample is in a range of from 0 gm through 100 gm.

<Production Method of Toner>

As a production method of the toner set of the present disclosure, methods known in the art, such as a melt-kneading and pulverizing method and a polymerization method can be used. Moreover, a production method of the color toner and a production method of the invisible toner may be identical production methods, or different production methods, such as a polymerization method for the color toner and a melt-kneading and pulverization method for the invisible toner.

<<Melt Kneading-Pulverization Method>>

As production steps, the melt kneading-pulverization method includes (1) melt-kneading at least a binder resin, a colorant or a near infrared light-absorbing material, and a release agent, (2) pulverizing and classifying the melt-kneaded toner composition, and (3) externally adding inorganic particles. Moreover, powder produced as a side product in the (2) pulverization and classification step is preferably side-kneaded as a raw material of (1) in terms of cost.

As a kneader used for the kneading, an enclosed kneader, a single or twin-screw extruder, an open-roll kneader, etc., can be used. Examples of a type of the kneader include KRC cokneader (available from KURIMOTO, LTD.), Buss Cokneader (available from Buss A.G.), TEM extruder (available from Toshiba Machine Co., Ltd.), TEX twin-screw extruder (available from KOBE STEEL, LTD.), PCM kneader (available from Ikegai, Ltd.), a three-roll mill, a mixing roll mill, a kneader (available from Inoue Mfg. Inc.), Kneadex (available from NIPPON COLE & ENGINEERING CO., LTD.), a MS pressure kneader, a kneader-ruder (available from Moriyama Company, Ltd.), and Banbury Mixer (available from Kobe Steel, Ltd.).

Examples of the pulverizer include a counter jet mill, a micron jet, an inomizer (available from Hosokawa Micron Corporation), IDS mill, PJM jet pulverizer (available from Nippon Pneumatic Mfg. Co., Ltd.), a cross jet mill (available from KURIMOTO, LTD.), Ulmax (available from Nisso Engineering Co., Ltd.), SK Jet-O-Mill (available from Seishin Enterprise Co., Ltd.), Clipton (available from Kawasaki Heavy Industries, Ltd.), Turbo Mill (available from Turbo Kogyo Co., Ltd.), and Super Rotor. (available from Nisshin Engineering Inc.).

Examples of the classifier include Classiel, Micron Classifier, Specific Classifier (available from Seishin Enterprise Co., Ltd.), turbo Classifier (available from Nisshin Engineering Inc.), Micron Separator, Turboplex (ATP), TSP Separator (available from Hosokawa Micron Corporation), Elbow-jet (available from Nittetsu Mining Co., Ltd.), Dispersion Separator (available from Nippon Pneumatic Mfg. Co., Ltd.), and YM Microcut (available from Uras Techno Co., Ltd.).

Examples of a sieving device used for sieving coarse particles include Ultrasonic (available from KOEI SANGYO CO., LTD.), resonasieve, Gyro-Sifter (TOKUJU CORPORATION), a vibrasonic system (available from Dalton Ltd.), Sonicreen (available from SINTOKOGIO, LTD.), Turboscreener (available from Turbo Kogyo Co., Ltd.), Microsifter (available from MAKINO Mfg. Co. Ltd.), and a circular vibrating screen.

<<Polymerization Method>>

As the polymerization method, methods known in the art can be used. Examples of the polymerization method include the following method. First, the colorant, the binder resin, and the release agent are dispersed in an organic solvent to prepare a toner material liquid (oil phase). To the toner material liquid, a polyester prepolymer having an isocyanate group (A) is preferably added to allow the polyester prepolymer to react during granulation to add a urea-modified polyester resin to a toner.

Next, the toner material liquid is emulsified in an aqueous medium in the presence of a surfactant and resin particles.

An aqueous solvent used for the aqueous medium may be water alone or may include an organic solvent such as alcohol.

An amount of the aqueous solvent used relative to 100 parts by mass of the toner material liquid is typically preferably from 60 parts by mass through 2,000 parts by mass and more preferably from 100 parts by mass through 1,000 parts by mass.

The resin particles are not particularly limited and may be appropriately selected depending on the intended purpose, as long as a resin of the resin particles can form an aqueous dispersion. Examples of the resin particles include a vinyl-based resin, a polyurethane resin, an epoxy resin, and a polyester resin.

After the dispersion, the organic solvent is removed from the emulsified dispersed elements (reaction product), followed by washing and drying the emulsified dispersed elements to thereby obtain toner base particles.

Each of the invisible toner and the color toner can be used as a one-component developer or used for a two-component developer.

In a case where the toner of the present disclosure is used for a two-component developer, the toner is used by mixing the toner with a magnetic carrier. As a ratio between the carrier and the toner in the developer, the toner is preferably from 1 part by mass through 10 parts by mass relative to 100 parts by mass of the carrier.

As the magnetic carrier, any of magnetic carrier known in the art can be used. Examples of the magnetic carrier include iron powder, ferrite powder, magnetite powder, and magnetic resin carrier, each having particle diameters of from about 20 micrometers through about 200 micrometers.

As the magnetic carrier, coated magnetic carrier may be used. Examples of a coating material for coating the magnetic carrier include: amino-based resins, such as urea-formaldehyde resins, melamine resins, benzoguanamine resins, urea resins, polyamide resins, and epoxy resins; polyvinylidene-based resins, such as polyvinyl; polystyrene-based resins, such as acrylic resins, polymethyl methacrylate resins, polyacrylonitrile resins, polyvinyl acetate resins, polyvinyl alcohol resins, polyvinyl butyral resins, polystyrene resins, and styrene-acryl copolymer resins; halogenated olefin resins, such as polyvinyl chloride; polyester-based resins, such as polyethylene tetraphthalate resins and polybutylene tetraphthalate resins; polycarbonate-based resins; polyethylene resins; polyvinyl fluoride resins; polyvinylidene fluoride resins; polytrifluoroethylene resins; polyhexafluoropropylene resins; copolymers of vinylidene fluoride and an acryl monomer; copolymer of vinylidene fluoride and vinyl fluoride; fluoroterpolymers, such as a terpolymer of tetrafluoroethylene, vinylidene fluoride, and a non-fluoromonomer; and silicone resins.

Optionally, conductive powder etc. may be added to the coating resin. As the conductive powder, metal powder, carbon black, titanium oxide, tin oxide, zinc oxide, etc. can be used. The conductive powder is preferably conductive powder having an average particle diameter of 1 micrometer or smaller. When the average particle diameter of the conductive powder is 1 micrometer or smaller, a problem that it is difficult to control electric resistance can be prevented.

(Image Forming Apparatus and Image Forming Method)

The image forming apparatus of the present disclosure includes an electrostatic latent image-bearing member, an electrostatic latent image-forming unit configured to form an electrostatic latent image on the electrostatic latent image-bearing member, a developing unit configured to develop the electrostatic image to form a toner image and storing an invisible toner for forming an invisible toner image and a color toner for forming a color toner image, a transferring unit configured to transfer the toner image to a recording medium, and a fixing unit configured to fix the toner image transferred to the recording medium. The image forming apparatus may further include appropriately selected other unit according to the necessity.

The image forming method of the present disclosure includes: forming an electrostatic latent image on an electrostatic latent image-bearing member; developing the electrostatic latent image to form a toner image; transferring the toner image to a recording medium; and fixing the toner image transferred on the recording medium. The image forming method may further include appropriately selected other steps according to the necessity.

The image forming method of the present disclosure is suitably performed by the image forming apparatus of the present disclosure.

As the invisible toner and the color toner, the toner set of the present disclosure can be used.

When the invisible toner image is a solid image in the image forming method and the image forming apparatus, 60-degree glossiness of the solid image is 30 or greater, preferably 30 or greater but 80 or less, and more preferably 30 or greater but 60 or less.

In one aspect of the image forming method and the image forming to apparatus, 60-degree glossiness of a solid image when the invisible toner image is the solid image is higher by 10 or greater, preferably 15 or greater, and more preferably 20 or higher than 60-degree glossiness of a solid image when the color toner image is the solid image.

In another aspect of the image forming method and the image forming apparatus, loss tangent (tan δi) of the invisible toner at from 100 degrees Celsius through 140 degrees Celsius is preferably 2.5 or greater and more preferably 3.0 or greater. In the image forming method and the image forming apparatus, moreover, loss tangent (tan δc) of the color toner is preferably 2 or less.

On a recording medium, the invisible toner image is preferably formed closer to the recording medium than the color toner image. Examples of a method for forming the invisible toner image closer to the recording medium than the color toner image include a method where a color toner image is formed after forming an invisible toner image on the recording medium.

The number of color toners used for forming the color toner image is not particularly limited and may be appropriately selected depending on the intended purpose. In a case where a plurality of the color toners are used, any of a method where an image is formed with a plurality of color toners at the same time, and a method where an image of a single color is repeatedly formed and the formed images of all of the colors are superimposed. Note that, in the process of formation of a color toner image, the order for forming each of color images is not particularly limited.

A deposition amount of the invisible toner of the invisible toner image is preferably 0.30 mg/cm$^2$ or greater but 0.45 mg/cm$^2$ or less and more preferably 0.35 mg/cm$^2$ or greater but 0.40 mg/cm$^2$ or less. When the deposition amount of the invisible toner is 0.30 mg/cm$^2$ or greater, a stable image can be obtained with a sufficient contrast ratio of the image against a base.

Since the near infrared light-absorbing material has slight absorption in a visible light region and is not completely colorless, moreover, visibility increases when an amount of the near infrared light-absorbing material added to the toner increases. Accordingly, visibility can be reduced by controlling the deposition amount of the invisible toner of the image to 0.45 mg/cm$^2$ or less.

A ratio (area ratio) between an area of the invisible toner image and an area of the color toner image disposed on the invisible toner image is preferably 80% or greater but 80% or less. When the area ratio is within the above-mentioned numerical range, it is preferable because visibility of the invisible toner image below the color toner image can be reduced.

The reason that the visibility of the invisible toner image is reduced is assumed as follows. The invisible toner for use in the present disclosure has slight absorption in a visible light range and therefore a single color image of the invisible toner is not completely clear. In order to achieve an object that is to provide invisible image information, the invisible toner image is masked with a color toner. When the area ratio of the color toner image is 80% or greater, a problem that the invisible toner image is easily visually recognized can be prevented. When the area ratio of the color toner image is 80% or less, particularly in a case where a yellow toner is superimposed, a problem that visibility of the invisible toner image increases can be prevented.

An image forming method where the area ratio of the color toner image on the invisible toner image is to be 30% or greater but 80% or less is effective especially when an image is formed by superimposing a two-dimensional coding image. Different types of information can be read on the same position by using readers of different light wavelength (860 nm and 582 nm respectively) when an image is formed by superimposing a two-dimensional coding image of an invisible toner containing different information and a two-dimensional coding image of a color toner. Therefore, a large quantity of information can be obtained.

On the recording medium, a two-dimensional coding image (i) that is the invisible toner image is preferably formed closer to the recording medium side than a two-dimensional coding image (c) that is the color toner image. When the color toner image is a solid image in this case, absorbance of the solid image at 800 nm or longer but 900 nm or shorter is preferably less than 0.05 and more preferably less than 0.01.

Moreover, the information the two-dimensional coding image (i) has and the information the two-dimensional coding image (c) has are preferably different.

When a two-dimensional coding image of the invisible toner and a two-dimensional coding image of the color toner are superimposed, the two-dimensional coding image of the color toner can be made as a dummy code. In this embodiment, the two-dimensional coding image of the invisible toner is not visually recognized and is only read by a two-dimensional code reader of infrared light, and the two-dimensional coding image of the color toner is visually recognized but cannot be read with the two-dimensional code reader of infrared light.

<Electrostatic Latent Image-Bearing Member>

A material, shape, structure, size, etc. of the electrostatic latent image-bearing member (may be referred to as an "electrophotography photoconductor", "photoconductor," or "image bearer") are not particularly limited and may be appropriately selected from those known in the art. Examples of the shape of the image bearer include a drum shape and a belt shape. Examples of the material of the image bearer include: inorganic photoconductors such as amorphous silicon and selenium; and organic photoconductors (OPC) such as polysilane and phthalopolymethine.

<Electrostatic Latent Image-Forming Step and Electrostatic Latent Image-Forming Unit>

The electrostatic latent image-forming step is a step including forming an electrostatic latent image on the electrostatic latent image-bearing to member.

For example, formation of the electrostatic latent image can be performed by uniformly charging a surface of the electrostatic latent image-bearing member, followed by exposing the charged surface of the electrostatic latent image-bearing member to light image wise. The formation of the electrostatic latent image can be performed by the electrostatic latent image-forming unit.

For example, the electrostatic latent image-forming unit includes at least a charging unit (charger) configured to uniformly charge a surface of the electrostatic latent image-bearing member, and an exposing unit (exposure device) configured to expose the charged surface of the electrostatic latent image-bearing member to light image wise.

For example, the charging can be performed by applying voltage to the surface of the electrostatic latent image-bearing member using the charger.

The charger is not particularly limited and may be appropriately selected depending on the intended purpose. Examples of the charger include: contact chargers known in the art per se, such as chargers equipped with a conductive or semiconductive roller, brush, film, or rubber blade; and non-contact chargers using corona discharge, such as corotron and scorotron.

The charger is preferably arranged in contact with or without contact with the electrostatic latent image-bearing member and is preferably configured to apply superimposed direct voltage and alternating voltage to charge a surface of the electrostatic latent image-bearing member. Moreover, the charger is preferably a charging roller arranged adjacent to the electrostatic latent image-bearing member in a non-contact manner via a gap tape, and configured to apply superimposed direct voltage and alternating voltage to charge a surface of the electrostatic latent image-bearing member.

For example, the exposure can be performed by exposing the charged surface of the electrostatic latent image-bearing member to light image wise using the exposure device.

The exposure device is not particularly limited and may be appropriately selected depending on the intended purpose, as long as the exposure device is capable of exposing the surface of the electrostatic latent image-bearing member charged by the charger to light image wise to be formed. Examples of the exposure device include various exposure devices, such as reproduction optical exposure devices, rod-lens-array exposure devices, laser optical exposure devices, and liquid crystal shutter optical exposure devices.

Note that, a black light system where image wise exposure is performed from a back side of the electrostatic latent image-bearing member may be employed in the present disclosure.

<Developing Step and Developing Unit>

The developing step is a step including developing the electrostatic latent image using the toner set to form a toner image.

For example, formation of the toner image can be performed by developing the electrostatic latent image using the toner set, and can be performed by the developing unit.

For example, the developing unit (may be referred to as a "developing deposition unit" hereinafter) is preferably a unit configured to accommodate each toner of the toner set and including at least a developing device capable of applying each toner of the toner set to the electrostatic latent image. The developing unit is more preferably a developing device equipped with a toner-containing container.

The developing device may be a developing device for a single color, or a developing device for multiple colors. Preferable examples of the developing device include a developing device including stirrer configured to stir each toner (may be merely referred to as "toner" hereinafter) of the toner set to cause frictions to thereby charge the toner, and a rotatable magnet roller.

Inside the developing device, for example, the toner and the carrier are mixed and stirred together to charge the toner due to friction caused by the mixing and stirring, and the charged toner is held on a surface of the rotating magnet roller in the form of a brush to thereby form a magnetic brush. Since the magnet roller is disposed adjacent to the electrostatic latent image-bearing member (photoconductor), part of the toner constituting the magnetic brush formed on the surface of the magnetic roller is transferred onto a surface of the electrostatic latent image bearing member (photoconductor) by electric suction force. As a result, the electrostatic latent image is developed with the toner to form a toner image formed of the toner on a surface of the electrostatic latent image-bearing member (photoconductor).

The toner image include an invisible toner image formed with the invisible toner and a color toner image formed with the color toner.

Examples of colors constituting the color toner include a 4-color set of black (Bk), cyan (C), magenta CM), and yellow (Y), a 3-color set of cyan (C), magenta (M), and yellow (Y), and a single color of black (Bk). Among the above-listed examples, a 4-color set is preferable because the 4-color set is a toner set that can be loaded in a typical electrophotographic 4-color image forming apparatus.

<Fixing Step and Fixing Unit>

The fixing step is a step including fixing the toner image transferred (transfer image) to a recording medium. The fixing step may be performed every time a developer of each color is transferred to the recording medium, or may be performed once on the developers of all colors in the state where all the colors are superimposed.

The fixing unit is not particularly limited and may be appropriately selected depending on the intended purpose, as long as the fixing unit is a unit configured to fix the transfer image transferred to the recording medium. The fixing unit is preferably any of heat-pressure units known in the art. Examples of the heat-pressure unit include a combination of a heat roller and a pressure roller, and a combination of a heat roller, a pressure roller, and an endless belt.

The fixing unit is preferably a unit including a heater equipped with a heating element, a film to be in contact with the heater, and a press member configured to press against the heater via the film, and configured to pass a recording medium to which an unfixed image is formed through a gap between the film and the pressure member to heat and fix the image. The heating performed by the heat-pressure member is preferably generally from 80 degrees Celsius through 200 degrees Celsius.

Note that, in the present disclosure, for example, a photo fixing device known in the art can be used together with or instead of the fixing step and the fixing unit depending on the intended purpose.

<Other Steps and Other Units>

Examples of the above-mentioned other steps include a charge-eliminating step, a cleaning step, a recycling step, and a controlling step.

Examples of the above-mentioned other units include a charge-eliminating unit, a cleaning unit, a recycling unit, and a controlling unit.

The charge-eliminating step is a step including applying charge-eliminating bias to the electrostatic latent image-bearing member to eliminate the charge of the electrostatic latent image-bearing member. The charge-eliminating step is suitably performed by the charge-eliminating unit.

The charge-eliminating unit is not particularly limited as long as the charge-eliminating unit can apply charge-eliminating bias to the electrostatic latent image-bearing member. The charge-eliminating unit is appropriately selected from charge eliminators known in the art. Examples of the charge-eliminating unit include a charge-eliminating lamp.

The cleaning step is a step including removing the toner remained on the electrostatic latent image-bearing member. The cleaning step is suitably performed by the cleaning unit.

The cleaning unit is not particularly limited as long as the cleaning unit is capable of removing the toner remained on the electrostatic latent image-bearing member. The cleaning unit is appropriately selected from cleaners known in the art. Preferable examples of the cleaning unit include a magnetic brush cleaner, a magnetic roller cleaner, a blade cleaner, a brush cleaner, and a web cleaner.

The recycling step is a step including recycling the toner removed by the cleaning step to the developing unit. The recycling step is suitably performed by the recycling unit. The recycling unit is not particularly limited. Examples of the recycling unit include conveyance units known in the art.

The controlling step is a step including controlling each step. The controlling step is suitably performed by the controlling unit.

The controlling unit is not particularly limited and may be appropriately selected depending on the intended purpose, as long as the controlling unit is capable of controlling operations of each unit. Examples of the controlling unit include devices, such as a sequencer and a computer.

The image forming method and image forming apparatus of the present disclosure will be described with reference to drawings hereinafter. FIG. 1 is a diagram illustrating an entire area of one example of the image forming apparatus A. Image data sent to an image processing unit (referred to as "IPU" hereinafter) (14) is used to create an image signal of each of 5 colors, invisible (Iv), yellow (Y), magenta (M), cyan (C), and black (Bk).

Next, the image processing unit transmits each image signal of Iv, Y, M, C, and Bk to a writing unit (15). The writing unit (15) modulates and scans each of 5 laser beams for Iv, Y, M, C, and Bk to sequentially form an electrostatic latent image on each of photoconductor drums (21, 22, 23, 24, and 25) after charging the photoconductor drums with charging units (51, 52, 53, 54, and 55. In FIG. 1, for example, the first photoconductor drum (21) corresponds to Iv, the second photoconductor drum (22) corresponds to Y, the third photoconductor drum (23) corresponds to M, the fourth photoconductor drum (24) corresponds to C, and the fifth photoconductor drum (25) corresponds to Bk.

Next, each of developing units (31, 32, 33, 34, and 85) each serving as a developing deposition unit form a toner image of each color on the photoconductor drum (21, 22, 23, 24, and 26). Moreover, a transfer sheet fed by a paper feeding unit (16) is transported on a transfer belt (70), and the toner images on the photoconductor drums (21, 22, 23, 24, and 26) are sequentially transferred on the transfer sheet by transfer chargers (61, 62, 63, 64, and 65).

After completing the transferring step, the transfer sheet is transported to a fixing unit (80), the toner images transferred onto the transfer sheet are fixed on the transfer sheet by the fixing unit (80), and the transfer sheet is then transported by a conveyance belt (90).

After completing the transferring step, the toners remained on the photoconductor drums (21, 22, 23, 24, and 25) are removed by cleaning units (41, 42, 48, 44, and 45).

In the device of FIG. 2 and an image forming method using the device, toner images formed on photoconductor drums (21, 22, 28, 24, and 25) in the same manner as in FIG. 1 are transferred a transfer drum once, and the toner images are transferred on a transfer sheet by a secondary transferring unit (66), followed by fixing by a fixing device (80). Both the image forming method 1 and the image forming method 2 can be used. When the invisible toner is deposited thickly, an invisible toner layer on the transfer drum becomes thick and it is difficult to perform secondary transfer. Accordingly, such an invisible toner image can be transferred to a separate transfer drum as in FIG. 3.

Next, a structure surrounding a developing unit will be explained.

FIG. 5 is an enlarged diagram illustrating one of the developing units (81, 32, 33, 34, and 85) as the 5 developing deposition units and one of the photoconductor drums (21, 22, 28, 24, and 25). Since the structures of the developing units and the photoconductors are the same other than a color of the toner for use is different, the developing unit and the photoconductor drum in FIG. 5 are referred to as a developing unit (4) and a photoconductor drum (1).

The developing unit (4) of the present embodiments includes a developer container (2) storing a two-component developer and a developing sleeve (11) serving as a developer bearing member that is rotatably disposed at an opening of the developer container (2) facing a photoconductor drum (1) with a space with the photoconductor (1). The developing sleeve (11) is formed of a cylinder of a non-magnetic material and rotates in a manner that the area of the developing sleeve facing the photoconductor (1) rotates in the same direction to the photoconductor (1) rotating in the direction indicated with an arrow. A magnetic roller that is a magnetic field-generating unit is fixed and disposed at the inner side of the developing sleeve (11). The magnetic roller has 5 magnetic poles (N1, S1, N2, N3, and S2). A regulating blade (10) serving as a developer regulating member is disposed at a part of a developer container (2) above the developing sleeve (11) and the regulating blade (10) is arranged without contact with the developer sleeve (11) towards near a magnetic pole (S2) positioned at almost the uppermost point of the magnetic roller in the vertical direction.

Inside the developer container (2), three developer conveyance channels, i.e., a supply conveyance channel (2*a*) including a supply screw (5) that is a first developer stirring-conveyance unit, a collection conveyance channel (2*b*) including a collection screw (6) that is a second developer stirring-conveyance unit, and a stirring conveyance channel (2*c*) including a stirring screw (7) that is a third developer stirring-conveyance unit, are disposed. The supply conveyance channel (2*a*) and the stirring conveyance channel (2*c*) are arranged in a diagonally up-down direction. Moreover, the collection conveyance channel (2*b*) is arranged at a downstream side of the developing region of the developing sleeve (11), and at a side substantially parallel to the stirring conveyance channel (2*c*).

The two-component developer stored in the developer container (2) is supplied from the supply conveyance channel (2*a*) to the developer sleeve (11), while being circulated and transported through the supply conveyance channel (2*a*), the collection conveyance channel (2*b*), and the stirring conveyance channel (2*c*) by stirring and conveyance performed by the supply screw (5), the collection screw (6), and stirring screw (7). The developer supplied to the developing sleeve (11) is lifted on the developing sleeve (11) with the magnetic pole (N2) of the magnetic roller. Along with the rotation of the developing sleeve (11), the developer is transported on the developing sleeve (11) from the magnetic pole (S2) to the magnetic pole (N1) and from the magnetic pole (N1) to the magnetic pole (S1), and the developer reaches a developing region where the developing sleeve (11) and the photoconductor (1) face each other. In the process of the transportation to the developer region, a thickness of the developer is magnetically regulated with the regulating blade (10) together with the magnetic pole (S2) to form a thin layer of the developer on the developing sleeve (11). The magnetic pole (S1) of the magnetic roller within the developing sleeve (11) positioned in the developing region a developing main pole, and the developer transported to the developing region is formed into a shape of bristles by the magnetic pole (S1) to be in contact with a surface of the photoconductor (1) to thereby develop an electrostatic latent image formed on the surface of the photoconductor (1). Along with the rotation of the developing sleeve (11), the developer with which the latent image is developed is passed through the developing region, is returned into the developer container (2) via the conveyance pole (N3), is released from the developing sleeve (11) with repulsive magnetic fields of the magnetic poles (N2 and N3), and is collected to the collection conveyance channel (2*b*) by the collection screw (6).

The supply conveyance channel (2*a*) and the collection conveyance channel (2*b*) disposed diagonally downwards relative to the supply conveyance channel (2*a*) are partitioned by a first partitioning member (3A).

The collection conveyance channel (2*b*) and the stirring conveyance channel (2*c*) disposed at the side relative to the collection conveyance channel (2*b*) are partitioned by a second partitioning member (3B). At the downstream part of the conveyance direction created by the collection screw (6) of the collection conveyance channel (2*b*), an opening for supply a developer, where the opening is configured to supply the collected developer to the stirring conveyance channel (2*c*), is disposed.

Moreover, the supply conveyance channel (2*a*) and the stirring conveyance channel (2*c*) disposed diagonally downwards relative to the supply conveyance channel (2*a*) are partitioned with a third partitioning member (C). At the upstream part and the downstream part of the conveyance direction created by the supply screw (5) of the supply conveyance channel (2*a*), openings for supplying a developer, where the openings are configured to supply the developer, are disposed.

FIG. 6 is a cross-sectional view illustrating the collection conveyance channel (2*b*) and the stirring conveyance channel (2*c*) at the downstream part of the conveyance direction created by the collection screw (6). An opening (2*d*) for communicating between the collection conveyance channel (2*b*) and the stirring conveyance channel (2*c*) is disposed.

FIG. 7 is a cross-sectional view illustrating the developing unit (4) at the upstream part of the conveyance direction created by the supply screw (5). An opening (2*e*) for communicating between the stirring conveyance channel (2*c*) and the supply conveyance channel (2*a*) is disposed in the third partitioning member (3C).

Moreover, FIG. 8 is a cross-sectional view illustrating the developing unit (4) at the downstream part of the conveyance direction created by the supply screw (5). An opening (2*f*) for communicating between the stirring conveyance channel (2*c*) and the supply conveyance channel (2*a*) is disposed in the third partitioning member (8C).

Next, circulation of the developer within the three developer conveyance channels will be explained.

FIG. 9 is a schematic view illustrating a flow of the developer within the developing unit (4). In FIG. 9, each arrow denotes a travelling direction of the developer. In the supply conveyance channel (2*a*) received the developer from the stirring conveyance channel (2*c*) transports the developer to the downstream side of the conveyance direction created by the supply screw (5) while supplying the developer to the developing sleeve (11). Then, the excess developer transported to the downstream part of the conveyance direction of the supply conveyance channel (2*a*) without being supplied to the developing sleeve (11) is supplied to the stirring conveyance channel (2*c*) from the opening (2*f*) disposed as a first developer-supplying opening in the third partitioning member (83C).

Moreover, the collected developer that is collected to the collection conveyance channel (2*b*) from the developing sleeve (11) by the collection screw (6) and is transported to the downstream part of the conveyance direction in the same direction to the developer of the supply conveyance channel (2*a*) is supplied to the stirring conveyance channel (2*c*) from the opening (2*d*) disposed as a second developer supplying opening in the second partitioning member (3B).

In the stirring conveyance channel (2*c*), the supplied excess developer and collected developer are stirred by the stirring screw (7) and are transported in the reverse direction to the direction of the flow of the direction in the collection conveyance channel (2*b*) and the supply conveyance channel (2*a*). Then, the developer transported to the downstream side of the conveyance direction of the stirring conveyance channel (2*c*) is supplied to the upstream part of the conveyance direction of the supply conveyance channel (2*a*) from the opening (2*e*) disposed as a third developer supply opening in the third partitioning member (SC).

Moreover, a toner concentration sensor (not illustrated) is disposed below the stirring conveyance channel (2*c*) and a toner supply-controlling device that is not illustrated is operated by output from the sensor to supply a toner from a toner accommodating unit (not illustrated). In the stirring conveyance channel (2*c*), a toner supplied from a toner supply opening (3) according to the necessity is transported to the downstream side of the conveyance direction with being stirred together with the collected developer and the excess developer by the stirring screw (7). When the toner is supplied, the toner is preferably supplied at the upstream of the stirring screw (7) because a long stirring time from the supply to the developing can be assured.

As described above, the developing unit (4) includes a supply conveyance channel (2*a*) and a collection conveyance channel (2*b*) and performs supply and collection of the developer in different developer conveyance channels. Therefore, the developer used for the developing is not mixed in the supply conveyance channel (2*a*). Accordingly, a tendency that larger reduction in the toner concentration of the developer supplied to the developing sleeve (11) is caused at the further downstream side of the conveyance direction of the supply conveyance channel (2*a*) can be prevented. Since the developing unit (4) includes the collection conveyance channel (2*b*) and the stirring conveyance channel (2*c*) and performs collection and stirring of the developer in different developer conveyance channels, moreover, the developer used for the developing does not drip during the stirring. Accordingly, the sufficiently stirred developer is supplied to the supply conveyance channel (2*a*) and therefore insufficient stirring of the developer supplied to the supply conveyance channel (2*a*) can be prevented.

As described above, reduction in the toner concentration in the developer within the supply conveyance channel (2*a*) can be prevented and insufficient stirring of the developer in the supply conveyance channel (2*a*) can be prevented. Therefore, image density during developing can be kept constant.

Moreover, at the upstream part of the conveyance direction of the supply conveyance channel (2*a*) illustrated in FIG. 7, the developer is supplied from the stirring conveyance channel (2*c*) disposed diagonally below to the supply conveyance channel (2*a*) disposed above. The exchanged of the above-mentioned exchanged of the developer is to supply the developer to the supply conveyance channel (2*a*) in the following manner. The developer is pushed in by the rotation of the stirring screw 7 to pile up the developer to spill the developer from the opening (2*e*) to supply to the supply conveyance channel (2*a*). Such movement of the developer gives stress to the developer and is a factor of reducing a service life of the developer.

Since the supply conveyance channel (2*a*) is arranged diagonally above the stirring conveyance channel (2*c*) in the developing unit (4), stress applied to the developer due to the upward movement of the developer can be reduced compared to a developing unit where the supply conveyance channel (2*a*) is disposed vertically above the stirring conveyance channel (2*c*) to lift the developer up.

At the downstream part of the conveyance direction created by the supply screw (5) illustrated in FIG. 8, moreover, an opening (2*f*) for communicating between the supply conveyance channel (2*a*) and the stirring conveyance channel (2*c*) is disposed for supplying the developer from the supply conveyance channel (2*a*) disposed above to the stirring conveyance channel (2*c*) disposed diagonally below. The third partitioning member (3C) partitioning into the stirring conveyance channel (2*c*) and the supply conveyance channel (2*a*) is extended upwards from the lowest point of the supply conveyance channel (2*a*) and the opening (2*f*) is disposed at the upper position relative to the lowest point. Moreover, FIG. 10 is a cross-sectional view illustrating a developing unit (4) at the most downstream part of the conveyance direction created by the supply screw (5). As illustrated in FIG. 10, at the downstream part relative to the opening (2*f*) in the conveyance direction created by the supply screw (5), an opening (2*g*) for communicating between the stirring conveyance channel (2*c*) and the supply conveyance channel (2*a*) is disposed in the third partitioning member (3C). Moreover, the opening (2*g*) is disposed upwards relative to the top of the opening (20.

In the supply conveyance channel (2*a*) having the openings (2*f* and 2*g*), among the developer transported to the opening (2*f*) through the supply conveyance channel (2*a*) along the axial direction by the supply screw (6), the volume of the developer reached to the height of the lowest part of the opening (2*f*) falls down to the stirring conveyance channel (2*c*) below via the opening (20. Meanwhile, the developer that does not reach the height of the lowest part of the opening (2*f*) is transported to the downstream side by the supply screw (5) to be supplied to the developing sleeve (11). Therefore, at the downstream side relative to the opening (2*f*) in the supply conveyance channel (2*a*), the volume of the developer becomes gradually lower than the lowest part of the opening (20. Since the most downstream part of the supply conveyance channel (2*a*) is dead end, the volume of the developer becomes high at the most downstream part. When the height of the developer reaches a certain height, the developer is pushed back against the rotations of the supply screw (5) and is returned to the opening (2*f*), and the developer reaching the height of the lowest part of the opening (2*f*) falls down to the stirring conveyance channel (2*c*) below via the opening (20. As a result, the volume of the developer does not continue to increase at the downstream side from the opening (2*f*) of the supply conveyance channel (2*a*) and the volume of the developer is in an equilibrium state with an inclination adjacent to the lowest part of the opening (20. By arranging the opening (2*g*) at a position higher than the uppermost part of the opening (2*f*), i.e. a position higher than the equilibrium state, sufficient ventilation can be assured in the stirring conveyance channel (2*c*) and the supply conveyance channel (2*a*) without blocking the opening (2*f*) with the developer to cause insufficient ventilation. Specifically, the opening (2*g*) exhibits a function as a ventilation opening for assuring sufficient ventilation between the supply conveyance channel (2*a*) and the stirring conveyance channel (2*c* as well as a function as an opening for supplying a developer between the supply conveyance channel (2*a*) and the stirring conveyance channel (2*c*). Since the ventilation opening (2*g*) is disposed, sufficient ventilation can be assured with the supply conveyance channel (2*a*) to which a filter for passing air through is disposed and arranged above the stirring conveyance channel (2*c*), even when internal pressure of the stirring conveyance channel (2*c*) disposed below and the collection conveyance channel (2*b*) communicating to the stirring conveyance channel (2*c*) increases, and therefore an increase in the internal pressure of the entire developing unit (4) can be prevented.

The toner set of the present disclosure can be used for a process cartridge including a photoconductor, and at least one selected from the group consisting of an electrostatic latent image-forming unit, a developing unit, and a cleaning unit where the photoconductor and the at least one unit are integrated and the process cartridge is detachably mounted in an image forming apparatus.

FIG. 4 illustrates a schematic structure of one example of an image forming apparatus equipped with a process cartridge including the developer for developing an electrostatic latent image for use in the present disclosure.

In FIG. 4, the process cartridge includes a photoconductor (20), an electrostatic latent image-forming unit (82), a developing unit (40), and a cleaning unit (61).

In the present disclosure, a plurality of units selected from the above-mentioned constitutional elements, such as the photoconductor (20), the electrostatic latent image-forming unit (32), the developing unit (40), and the cleaning unit (61), are integrated as a process cartridge, and the process cartridge is structure to be detachable to a main body of an image forming apparatus, such as a photocopier and a printer.

An operation of an image forming apparatus equipped with a process cartridge including the developer for developing an electrostatic latent image of the present disclosure will be explained as follows.

A photoconductor is driven to rotate at the predetermined rim speed. In the process of the rotation of the photoconductor, a circumferential surface of the photoconductor is uniformly charged with predetermined positive or negative voltage by the electrostatic latent image-forming unit. Subsequently, the surface of the photoconductor is exposed to image exposure light emitted from an image exposure unit, such as a slit exposure and laser beam scanning exposure to sequentially form electrostatic latent images on the circumferential surface of the photoconductor. Next, the formed electrostatic latent images are developed with toners by the developing unit to form toner images. The developed toner images are sequentially transferred by the transferring unit to a transfer sheet fed from the paper feeding unit between the photoconductor and the transferring unit with synchronizing the rotations of the photoconductor. The transfer sheet to which the image has been transferred is separated from the surface of the photoconductor and is introduced into an image fixing unit to fix the image. The resultant is printed out as a copy from the apparatus to the outside the apparatus. The surface of the photoconductor after transferring the images is cleaned by removing the residual toner after transferring by the cleaning unit, followed by eliminating the charge, to be ready for the following image formation.

EXAMPLES

The present disclosure will be described in more detail by way of the following Examples. However, the present disclosure should not be construed as being limited to these Examples. Note that, "part(s)" denotes "part(s) by mass" unless otherwise stated.

<Production of Invisible Toner 1>

Polyester Resin 1 (RN-806SF, available from Kao Corporation, weight average molecular weight Mw: 7,700, acid value: 4 mgKOH/g): 80 parts Polyester Resin 2 (RN-300SF, available from Kao Corporation, weight average molecular weight Mw: 11,000, acid value: 4 mgKOH/g): 10 parts Wax dispersing agent (EXD-001, available from Sanyo Chemical Industries, Ltd.): 4 parts Monoester Wax 1 (melting point mp: 70.6 degrees Celsius): 6 parts Zirconium Salicylate Derivative A: 0.9 parts Vanadyl naphthalocyanine: 0.3 parts Note that, a compound represented by Structural Formula (1) below was used as the vanadyl naphthalocyanine serving as a near infrared light-absorbing material and a compound represented by Structural Formula (2) below was used as Zirconium Salicylate Derivative A.

[Chem.2]

Structural Formula (1)

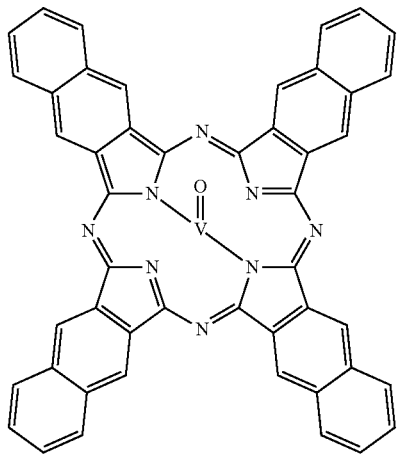

[Chem.3]

Structural Formula (2)

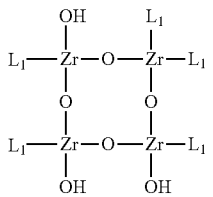

In Structural Formula (2), $L_1$ represents the following structure.

[Chem.4]

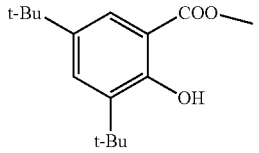

Toner raw materials of the composition above were premixed by means of HENSCHEL MIXER (FM20B, available from NIPPON COLE & ENGINEERING CO., LTD.), followed by melting and kneading the mixture by means of a monoaxial kneader (cokneader, available from Buss) at a temperature from 100 degrees Celsius through 130 degrees Celsius.

The obtained kneaded product was cooled down to room temperature, followed by roughly pulverizing the kneaded product into 200 micrometers through 300 micrometers by Rotoplex.

The roughly pulverized particles were finely pulverized by means of a counter jet mill (100AFG, available from HOSOKAWAMICRON CORPORATION) with appropriately adjusting pulverization air pressure in a manner that a weight average particle diameter of the resultant particles was to be 4.5 micrometers±0.3 micrometers, followed by classifying the resultant particles by means of an air classifier (EJ-LABO, available from MATSUBO Corporation) with appropriately adjusting an opening degree of a louver in a manner that a weight average particle diameter of the resultant particles was to be 5.2 micrometers±0.2 micrometers and a ratio of the weight average particle diameter/number average particle diameter was to be 1.20 or less, to obtain Toner Base Particles 1.

Subsequently, as additives, 1.3 parts of fumed silica (ZD-30ST, available from Tokuyama Corporation), 1.5 parts of fumed silica (UFP-35HH, available from Denka Company Limited), and 1.0 part of titanium dioxide (MT-150AFM, available from TAYCA CORPORATION) were added to 100 parts by mass of Toner Base Particles 1 and the resultant was stirred and mixed by HENSCHEL MIXER to produce Invisible Toner 1.

<Production of Invisible Toner 2>

Invisible Toner 2 was produced in the same manner as Invisible Toner 1, except that the amount of the vanadyl naphthalocyanine was changed to 0.6 parts.

<Production of Invisible Toner 3>

Invisible Toner 3 was produced in the same manner as Invisible Toner 1, except that the amount of the vanadyl naphthalocyanine was changed to 1.0 part.

<Production of Invisible Toner 4>

Invisible Toner 4 was produced in the same manner as Invisible Toner 2, except that Polyester Resin 2 was replaced with Polyester Resin 3 (RN-290SF, available from Kao Corporation, Mw: 87,000, acid value: 28 mgKOH/g).

Note that, Polyester Resin 3 was a resin synthesized from bisphenol A-polyethylene oxide adduct alcohol, bisphenol A-ethylene oxide adduct alcohol, fumaric acid, and trimellitic anhydride.

<Production of Invisible Toner 6>

Invisible Toner 6 was produced in the same manner as Invisible Toner 4, except that the amount of Polyester Resin 1 was changed to 70 parts and the amount of Polyester Resin 3 was changed to 20 parts.

<Production of Invisible Toner 6>

In the production of Invisible Toner 4, the amount of the vanadyl naphthalocyanine was changed to 0.8 parts and in the pulverization and classification step, the toner base particles were produced to have a weight average particle diameter of 6.8 micrometers±0.2 micrometers. Subsequently, 0.8 parts of fumed silica (ZD-30ST, available from Tokuyama Corporation), 1.0 part of fumed silica (UFP-85HH, available from Denka Company Limited), 0.6 parts of titanium dioxide (MT-150AFM, available from TAYCA CORPORATION) were added to 100 parts by mass of the toner base particles and the resultant was stirred and mixed by means of HENSCHEL MIXER to thereby produce Invisible Toner 6.

<Production of Invisible Toner 7>

Invisible Toner 7 was produced in the same manner as Invisible Toner 6, except that the amount of the vanadyl naphthalocyanine was changed to 0.6 parts.

<Production of Invisible Toner 8>

Invisible Toner 8 was produced in the same manner as Invisible Toner 5, except that the amount of Zirconium Salicylate Derivative A was changed to 1.5 parts.

<Production of Invisible Toner 9>

In the pulverization and classifying step of Invisible Toner 4, the toner base particles were produced to have a weight average particle diameter of 8.0 micrometers±0.2 micrometers.

Subsequently, 0.6 parts of fumed silica (ZD-80ST, available from Tokuyama Corporation), 0.8 parts of fumed silica (UFP-85HH, available from Denka Company Limited), and 0.5 parts of titanium dioxide (MT-150AFM, available from TAYCA CORPORATION) were added to 100 parts of toner base particles, and the resultant was stirred and mixed by means of HENSCHEL MIXER to produce Invisible Toner 9.

<Production of Invisible Toner 10>

Invisible Toner 10 was produced in the same manner as Invisible Toner 1, except that the amount of the vanadyl naphthalocyanine was changed to 0.2 parts.

<Production of Invisible Toner 11>

Invisible Toner 11 was produced in the same manner as Invisible Toner 4, except that the amount of the vanadyl naphthalocyanine was changed to 1.2 parts.

<Production of Invisible Toner 12>

Invisible Toner 12 was produced in the same manner as Invisible Toner 4, except that the amount of Polyester Resin 1 was changed to 60 parts and the amount of Polyester Resin 3 was changed to 30 parts.

<Production of Invisible Toner 18>

Invisible Toner 13 was produced in the same manner as Invisible Toner 6, except that "0.3 parts of vanadyl naphthalocyanine" was replaced with "1.0 part of Near Infrared Absorbing Dye 1 (OPTLION NIR-761, available from TOYOCOLOR CO., LTD.)."

<Production of Invisible Toner 14>

Invisible Toner 14 was produced in the same manner as Invisible Toner 6, except that "0.3 parts of vanadyl naphthalocyanine" was replaced with "2.0 parts of Near Infrared Absorbing Dye 1 (OPTLION NIR-761, available from TOYOCOLOR CO., LTD.)."

<Production of Perylene Black Toner 1>

Polyester Resin 1 (RN-306SF, available from Kao Corporation, weight average molecular weight Mw: 7,700, acid value: 4 mgKOH/g): 70 parts Polyester Resin 3 (RN-290SF, available from Kao Corporation, weight average molecular weight Mw: 87,000, acid value: 28 mgKOH/g): 20 parts Wax dispersing agent (EXD-001, available from Sanyo Chemical Industries, Ltd.): 4 parts Monoester wax (WE-11, available from NOF CORPORATION, melting point mp: 67 degrees Celsius): 6 parts Zirconium Salicylate Derivative A: 0.9 parts Perylene Black 1 (PALIOGEN BLACK L0086, available from BASF): 8 parts Note that, Polyester Resin 8 was a resin synthesized from bisphenol A-polyethylene oxide adduct alcohol, bisphenol A-ethylene oxide adduct alcohol, fumaric acid, and trimellitic anhydride.

Raw materials of the perylene black toner above were pre-mixed by means of HENSCHEL MIXER (FM20B, available from NIPPON COLE & ENGINEERING CO., LTD.), followed by melting and kneading the mixture by means of a monoaxial kneader (cokneader, available from Buss) at a temperature from 100 degrees Celsius through 130 degrees Celsius.

The obtained kneaded product was cooled down to room temperature, followed by roughly pulverizing the kneaded product into 200 micrometers through 300 micrometers by Rotoplex. Subsequently, the roughly pulverized particles were finely pulverized by means of a counter jet mill (100AFG, available from HOSOKAWAMICRON CORPORATION) with appropriately adjusting pulverization air pressure in a manner that a weight average particle diameter of the resultant particles was to be 4.5 micrometers±0.3 micrometers, followed by classifying the resultant particles by means of an air classifier (EJ-LABO, available from MATSUBO Corporation) with appropriately adjusting an opening degree of a louver in a manner that a weight average particle diameter of the resultant particles was to be 6.2 micrometers±0.2 micrometers and a ratio of the weight average particle diameter/number average particle diameter was to be 1.20 or less, to obtain perylene black toner base particles.

Subsequently, 1.3 parts of fumed silica (ZD-30ST, available from Tokuyama Corporation), 1.5 parts of fumed silica (UFP-35HH, available from Denka Company Limited), and 1.0 part of titanium dioxide (MT-150AFM, available from TAYCA CORPORATION) were added to 100 parts of the perylene black toner base particles, and the resultant was stirred and mixed by means of HENSCHEL MIXER to produce a perylene black toner.

<Production of Perylene Black Toner 2>

Perylene Black Toner 2 was produced in the same manner as Perylene Black Toner 1, except that "8 parts of Perylene Black 1 (PALIOGEN BLACK L0086, available from BASF)" was replaced with "7 parts of Perylene Black 1 (PALIOGEN BLACK S0084, available from BASF) and 2 parts of Pigment Yellow 185 (Paliotol Yellow D1155, available from BASF).

<Measurement of Loss Tangent (Tan δ)>

Loss tangents (tan δ) of the obtained invisible toners and perylene black toners, and color toners used below were measured in the following manner. Each toner in an amount of 0.8 g was molded at pressure of 30 MPa using a die having a diameter of 20 mm. Next, measurements of loss modulus (G"), storage elastic modulus (G'), and loss tangent (tan δ) were performed in a temperature range of from 100 degrees Celsius through 140 degrees Celsius were performed by means of ADVANQED RHEOMETRIC EXPANSION SYSTEM (available from TA Instruments) using a parallel corn having a diameter of 20 mm at a frequency of 1.0 Hz, heating speed of 2.0 degrees Celsius/min, strain of 0.1% (automatic strain control, optimum minimum stress: 1.0 g/cm, optimum maximum stress: 600 g/cm, maximum additional strain: 200%, strain adjustment: 200%), and with GAP with which force after setting the sample was in a range of from 0 gm through 100 gm.

<Production of Two-Component Developer>

<<Preparation of Carrier>>

Silicone resin (organo straight silicone): 100 parts

Toluene: 100 parts

Gamma-(2-aminoethyl)aminopropyltrimethoxysilane: 5 parts

Carbon black: 10 parts

The mixture was dispersed by means of a homomixer for 20 minutes to prepare a coating layer-forming liquid. The coat layer-forming liquid was applied to Mn ferrite particles having a weight average particle diameter of 85 micrometers used as cores by means of a fluidized bed coating device a in a manner that an average film thickness on a surface of the core was to be 0.20 micrometers and the coated liquid was dried with controlling a temperature inside the fluidized bed to 70 degrees Celsius. The resultant was baked in an electric furnace at 180 degrees Celsius for 2 hours to thereby obtain a carrier.

<<Production of Developer (Two-Component Developer)>>

Each of Invisible Toners 1 to 14 and Perylene Black Toners 1 and 2 produced above was homogeneously mixed with the carrier by means of a turbula mixer (available from Willy A. Bachofen (WAB)) for 5 minutes at 48 rpm to produce each of Developers 1 to 14 and Perylene Black Developers 1 and 2.

A blending ratio of the toner and the carrier was matched to the toner density (5% by mass) of the initial developer of an evaluation device.

Examples 1 to 10, 13, 14, and Comparative Examples 1 to 2

In a digital full color multifunction peripheral (Imagio Neo C600, available from Ricoh Company Limited, abbreviated as "neo C600" hereinafter) including 4 colors of developers, a black developer, a yellow developer, a magenta developer, and a cyan developer, the black developer was replaced with each of Two-Component Developers 1 to 12 to thereby provide an apparatus including a toner set including an invisible toner and color toners.

The absorbance of the color toner (yellow, magenta, and cyan) included in the yellow developer, the magenta developer, and the cyan developer at a wavelength of 800 nm or longer was less than 0.01.

<Measurement of Absorbance>

A solid image patch was output on an OHP film (type PPC-FC, available from Ricoh Company Limited) by neo C600 in a manner that a toner deposition amount was to be 0.5 mg/cm$^2$. Spectral transmittance T of the solid image patch with light of from 800 nm through 900 nm was measured by means of a spectrophotometer (V-660DS, available from JASCO Corporation) with using, as a blank, an OHP film to which an image was not output. Absorbance A was calculated from the obtained spectral transmittance T according to a formula below.

$$A=-\log T$$

(Evaluation of Deposition Amount and Evaluation of Glossiness)

First, a solid image patch of each color of the color toner in the size of 5 cm×5 cm using a PPC sheet TYPE6000 (70 W) available from Ricoh Company Limited as a sheet. The deposition amount of the color toner and glossiness (60-degree glossiness) of the output sheet are presented in Table 2.

<Evaluation of Deposition Amount>

The fixing unit of the neo C600 was taken out, and an unfixed solid image patch in the size of 5 cm×5 cm was output. An area of the solid image patch was cut out by a pair of scissors to prepare a cut piece. A mass of the prepared cut piece was measured by a precision balance. The toner of the solid image patch area (unfixed image) was blown off by an air gun, and a mass of the cut piece was measured. A toner deposition amount was calculated from the values of mass before and after blowing the toner off with the air gun according to the following equation. The result is presented in Table 1.

Toner deposition amount (mg/cm$^2$)=((mass of cut piece with solid image patch)−(mass of cut piece after blowing off))/25

<Evaluation of Glossiliess>

Glossiness of a fixed solid image patch in the size of 5 cm×5 cm output by the neo C600 was measured at 4 positions by a gloss meter (VGS-1D, available from NIPPON DENSHOKU INDUSTRIES CO., LTD.). An average value of the evaluation results obtained from the 4 positions was calculated and determined as glossiness. The result is presented in Table 1.

(Evaluation of Visibility and Evaluation of Readability)

The evaluation of visibility and the evaluation of readability were performed in the following manner.

QR code (registered trademark) was printed with an invisible toner using the device and sheet presented in Table 3, and the pattern depicted in FIG. 11A was printed on QR code (registered trademark) to prepare QR code (registered trademark) hidden in the pattern depicted in FIG. 11B. Moreover, QR code (registered trademark) was printed with the invisible toner in the area the entire part of which was colored (the region of A in FIG. 12) as depicted in FIG. 12. Below QR code (registered trademark) printed with the color toner, QR code (registered trademark) including information different from the information of QR code (registered trademark) printed with the color toner was printed with the invisible toner (the region of B in FIG. 12).

Visibility of the invisible toner image and readability of QR code (registered trademark) output with the invisible toner in the image were evaluated from the prints of FIGS. 11A, 11B, and 12. The results are presented in Table 3. Note that, in FIG. 11A, the invisible toner image that was originally invisible was visibly displayed.

<Evaluation of Visibility>

Randomly selected 20 monitors observed the invisible image formed in the print of FIG. 12. When two or more monitors were able to visually recognize the invisible image, visibility was determined as A. When three or more monitors but five or less monitors were able to visually recognize the invisible image, visibility was determined as B. When six or more monitors were able to visually recognize the invisible image, visibility was determined as C.

<Evaluation of Readability>

The prints of FIGS. 11A, 11B, and 12 were output on 10 sheets each, and all of invisible QR codes (registered trademark) formed on the output images were read by a QR code (registered trademark) two-dimensional barcode reader (a modified product in which a 870 nm band-pass filter (870nmBPF, available from CERATECH JAPAN Co., Ltd.) was attached to model number: CM-2D200K2B, available from A-POC Corporation). A case where all of the QR codes (registered trademark) were able to be read by one scan was evaluated as A, a case where all of the QR codes (registered trademark) were read but there was the QR code (registered trademark) scanned few times was evaluated as B, and a case where there was at least one QR code that was not be able to be scanned was evaluated as C.

Example 11

A production printer (RICOH Pro C7110, available from Ricoh Company Limited) including 5 colors, i.e., a yellow toner, a magenta toner, a cyan toner, a black toner, and a special color toner was used. The black toner of the printer was replaced with the invisible toner presented in Table 4 to prepare a toner set including the invisible toner and color toners. Moreover, the originally loaded black toner was set to the special color toner-mounted unit to prepare a toner set of Example 8. Absorbance of the color toners (yellow, magenta, and cyan) at a wavelength of 800 nm or longer was less than 0.01. Moreover, absorbance of the black toner at a wavelength of 800 nm or longer was larger than 0.01.

As a sheet, coated glossy paper (135 g/m$^2$, available from Mondi plc) was used. A solid image patch in the size of 5 cm×5 cm was output on the sheet using each color of the color toners. A deposition amount and glossiness of each color of the color toners were measured in the same manner as above. The measurement results are presented in Table 4. Moreover, a deposition amount of glossiness of each invisible toner were also measured in the same manner. The measurement results are presented in Table 1.

Next, prints of FIGS. 11A, 11B, and 12 were output and visibility and readability of the invisible toner images were evaluated in the same manner as above. The results are presented in Table 4.

Note that the black toner set in the special color toner developer-mounted unit was set in a manner that the black toner was not used for an image other than texts.

Example 12

A toner set was provided in the same manner as in Example 8, except that Perylene Black Toner 1 was used as a special color toner. Absorbance of Perylene Black Toner 1 at a wavelength of 800 nm or longer was less than 0.01.

As a sheet, coated glossy paper (135 g/m$^2$, available from Mondi plc) was used. To the sheet, a solid image patch in a size of 5 cm×5 cm was output using each color of the toner toners, and a deposition amount and glossiness of each color of the color toners were measured in the same manner as described above. The measurement results are presented in Table 4. Moreover, a deposition amount and glossiness of each invisible toner were measured in the same manner. The measurement results are presented in Table 1.

Next, prints of FIGS. 11A, 11B, and 12 were output and visibility and readability of the invisible toner images were evaluated in the same manner as above. The results are presented in Table 4.

Note that, Perylene Black Toner 1 was set in a manner that Perylene Black Toner 1 was used in all of images as usual.

Comparative Example 3 and Example 17

Evaluations were performed in the same manner as in Example 12, except that the invisible toner was replaced with the invisible toner presented in Table 4. The evaluation results are presented in Table 4.

Comparative Example 4

Evaluations were performed in the same manner as in Example 11, except that the invisible toner was replaced with the invisible toner presented in Table 4. The evaluation results are presented in Table 4.

Example 15

Evaluations were performed in the same manner as in Example 11, except that the invisible toner was replaced with the invisible toner presented in Table 4. The evaluation results are presented in Table 4.

Example 16

Evaluations were performed in the same manner as in Example 12, except that the special color toner was replaced with Perylene Black Toner 2 and the invisible toner was replaced with the invisible toner presented in Table 4. Absorbance of Perylene Black Toner 2 at a wavelength of 800 nm or longer was less than 0.01. The evaluation results are presented in Table 4.

TABLE 1

| | Developer No. | Addition amount of near infrared light-absorbing material (mass parts) | Particle diameter (micro meters) | *Device, Sheet 1 Deposition amount (mg/cm$^2$) | *Device, Sheet 1 Glossiness of solid image | *Device, Sheet 2 Deposition amount (mg/cm$^2$) | *Device, Sheet 2 Glossiness of solid image | Loss tangent at 100° C. through 140° C. (tanδi) |
|---|---|---|---|---|---|---|---|---|
| Invisible Toner 1 | 1 | 0.3 | 5.2 | 0.3 | 50 | 0.3 | 90 | 4 through 10 |
| Invisible Toner 2 | 2 | 0.6 | 5.2 | 0.35 | 50 | 0.35 | 94 | 4 through 10 |
| Invisible Toner 3 | 3 | 1.0 | 5.2 | 0.45 | 50 | 0.45 | 96 | 4 through 10 |
| Invisible Toner 4 | 4 | 0.6 | 5.2 | 0.35 | 36 | 0.35 | 58 | 3 through 8 |
| Invisible Toner 5 | 5 | 0.6 | 5.2 | 0.35 | 36 | 0.35 | 58 | 3 through 8 |
| Invisible Toner 6 | 6 | 0.3 | 6.8 | 0.35 | 34 | 0.35 | 58 | 3 through 8 |
| Invisible Toner 7 | 7 | 0.6 | 6.8 | 0.35 | 33 | 0.35 | 57 | 3 through 8 |
| Invisible Toner 8 | 8 | 0.6 | 5.2 | 0.35 | 12 | 0.35 | 33 | 0.4 through 1.2 |
| Invisible Toner 9 | 9 | 0.6 | 8.0 | 0.35 | 30 | 0.35 | 58 | 3 through 8 |
| Invisible Toner 10 | 10 | 0.2 | 5.2 | 0.3 | 51 | 0.3 | 90 | 4 through 10 |
| Invisible Toner 11 | 11 | 1.2 | 5.2 | 0.45 | 50 | 0.45 | 62 | 3 through 8 |
| Invisible Toner 12 | 12 | 0.6 | 5.2 | 0.35 | 3 | 0.35 | 5 | 0 through 0.2 |
| Invisible Toner 13 | 13 | 1.0 | 6.8 | 0.35 | 34 | 0.35 | 58 | 3 through 8 |
| Invisible Toner 14 | 14 | 2.0 | 6.8 | 0.4 | 37 | 0.4 | 62 | 3 through 8 |
| Perylene Black Toner 1 | Perylene Black Developer 1 | — | 5.2 | | | 0.4 | 35 | 0.4 through 1.2 |
| Perylene Black Toner 2 | Perylene Black Developer 2 | — | 5.2 | | | 0.35 | 35 | 0.4 through 1.2 |

In Tables 1 to 4, "*Device, Sheet 1" and "*Device, Sheet 2" denote the following devices and sheets.

Device, Sheet 1: imagio neo C600 (Device), Ricoh PPC sheet TYPE6000 (70 W) (Sheet)

Device, Sheet 2: RICOH Pro C7110 (Device), Coated glossy paper (Sheet)

TABLE 2

| | *Device, Sheet 1 Particle diameter (μm) | *Device, Sheet 1 Deposition amount (mg/cm$^2$) | *Device, Sheet 1 Glossiness of solid image | *Device, Sheet 1 Loss tangent at 100° C. through 140° C. (tan δc) | *Device, Sheet 2 Particle diameter (μm) | *Device, Sheet 2 Deposition amount (mg/cm$^2$) | *Device, Sheet 2 Glossiness of solid image | *Device, Sheet 2 Loss tangent at 100° C. through 140° C. (tan δc) |
|---|---|---|---|---|---|---|---|---|
| Black Toner | 6.8 | 0.5 | 15 | 0.4-1.6 | 5.2 | 0.4 | 28 | 0.4-1.2 |
| Yellow Toner | 6.8 | 0.5 | 18 | 0.4-1.6 | 5.2 | 0.4 | 33 | 0.4-1.2 |
| Magenta Toner | 6.8 | 0.5 | 16 | 0.4-1.6 | 5.2 | 0.4 | 30 | 0.4-1.2 |
| Cyan Toner | 6.8 | 0.5 | 18 | 0.4-1.6 | 5.2 | 0.4 | 34 | 0.4-1.2 |

TABLE 3

| | *Device, Sheet | Invisible Toner | Visibility | Reading accuracy | Judgement |
|---|---|---|---|---|---|
| Ex. 1 | 1 | 1 | A | A | A |
| Ex. 2 | 1 | 2 | A | A | A |
| Ex. 3 | 1 | 3 | A | A | A |
| Ex. 4 | 1 | 4 | A | A | A |
| Ex. 5 | 1 | 5 | A | A | A |
| Ex. 6 | 1 | 6 | A | A | A |
| Ex. 7 | 1 | 7 | A | A | A |
| Ex. 8 | 1 | 9 | A | B | B |

TABLE 3-continued

| | *Device, Sheet | Invisible Toner | Visibility | Reading accuracy | Judgement |
|---|---|---|---|---|---|
| Ex. 9 | 1 | 10 | A | B | B |
| Ex. 10 | 1 | 11 | B | A | B |
| Comp. Ex. 1 | 1 | 8 | C | A | C |
| Comp. Ex. 2 | 1 | 12 | C | C | C |
| Ex. 13 | 1 | 13 | A | A | A |
| Ex. 14 | 1 | 14 | A | A | A |

TABLE 4

| | *Device, Sheet | Invisible Toner | Black Toner | Visibility | Reading accuracy | Judgement |
|---|---|---|---|---|---|---|
| Ex. 11 | 2 | 2 | No change | A | A | A |
| Ex. 12 | 2 | 2 | Perylene 1 | A | A | A |

TABLE 4-continued

| | *Device, Sheet | Invisible Toner | Black Toner | Visibility | Reading accuracy | Judgement |
|---|---|---|---|---|---|---|
| Comp. Ex. 3 | 2 | 8 | Perylene 1 | C | A | C |
| Comp. Ex. 4 | 2 | 12 | No change | C | C | C |
| Ex. 15 | 2 | 13 | No change | A | A | A |
| Ex. 16 | 2 | 14 | Perylene 2 | A | A | A |
| Ex. 17 | 2 | 9 | Perylene 1 | A | B | B |

Note that, "Judgement" in Tables 8 and 4 was performed by evaluating a case where both the visibility and the reading accuracy were "A" as "A," evaluating a case where either the visibility or the reading accuracy was "B" as "B," and evaluating a case where either the visibility or the reading accuracy was "C" was "C." The judgement being "A" means that visibility and reading accuracy are excellent, "B" means that visibility and reading accuracy are insufficient but there is no problem on practical use, and "C" means that visibility and reading accuracy are insufficient and there is a problem on practical use.

As demonstrated above, the toner set, developer, and image forming method of the present disclosure can provide a toner set, an image forming method, and the image forming apparatus can form an invisible image to which information is recorded with high density without impairing image quality of a visible image and can form an invisible image in an arbitrary region regardless of a region in which a visible image is formed on a surface of an image output medium, when an image of relatively low gloss is formed utilizing characteristics of electrophotography and the visible image formed together with the invisible image on the surface of the image output medium is visually observed.

For example, embodiments of the present invention are as follows.

<1> A toner set including:

a color toner including a binder resin and a colorant; and an invisible toner including a binder resin and a near infrared light-absorbing material, wherein 60-degree glossiness of a solid image of the invisible toner is 30 or greater, and the 60-degree glossiness of the solid image of the invisible toner is higher than 60-degree glossiness of a solid image of the color toner by 10 or greater.

<2> A toner set including:

a color toner including a binder resin and a colorant; and an invisible toner including a binder resin and a near infrared light-absorbing material, wherein loss tangent (tan δi) of the invisible toner at from 100 degrees Celsius through 140 degrees Celsius is 2.5 or greater, and loss tangent (tan δc) of the color toner at from 100 degrees Celsius through 140 degrees Celsius is 2 or less.

<3> The toner set according to <1> or <2>, wherein the near infrared light-absorbing material is a naphthalocyanine compound.

<4> The toner set according to any one of <1> to <3>, wherein an amount of the near infrared light-absorbing material in the invisible toner is 0.3% by mass or greater but 1.0% by mass or less.

<5> The toner set according to any one of <1> to <4>, wherein a weight average particle diameter of the invisible toner is 6.0 micrometers or greater but 7.0 micrometers or less.

<6> The toner set according to one of <1> to <5>, wherein the color toner is a cyan toner, a magenta toner, a yellow toner, or a black toner, and absorbance of the solid image of the color toner at 800 nm or longer is less than 0.05.

<7> The toner set according to <6>, wherein the black toner includes a compound having a perylene structure.

<8> An image forming method including:

forming an electrostatic latent image on an electrostatic latent image-bearing member;

developing the electrostatic latent image to form a toner image; transferring the toner image to a recording medium; and fixing the toner image transferred on the recording medium, wherein the toner image includes an invisible toner image and a color toner image, the invisible toner image is formed with an invisible toner including a binder resin and a near infrared light-absorbing material, the color toner image is formed with a color toner including a binder resin and a colorant, when the invisible toner image is a solid image, 60-degree glossiness of the solid image is 30 or greater, and when the 60-degree glossiness of the solid image when the invisible toner is the solid image is higher by 10 or higher than 60-degree glossiness of a solid image when the color toner image is the solid image.

<9> An image forming method including:

forming an electrostatic latent image on an electrostatic latent image-bearing member;

developing the electrostatic latent image to form a toner image; transferring the toner image to a recording medium; and fixing the toner image transferred on the recording medium, wherein the toner image includes an invisible toner image and a color toner image, the invisible toner image is formed with an invisible toner including a binder resin and a near infrared light-absorbing material, the color toner image is formed with a color toner including a binder resin and a colorant, loss tangent (tan δi) of the invisible toner at from 100 degrees Celsius through 140 degrees Celsius is 2.5 or greater, and loss tangent (tan δc) of the color toner at from 100 degrees Celsius through 140 degrees Celsius is 2 or less.

<10> The image forming method according to <8> or <9>, wherein the invisible toner image is formed closer to the recording to medium than the color toner image.

<11> The image forming method according to any one of <8> to <10>, wherein a deposition amount of the invisible toner of the invisible toner image is 0.30 mg/cm$^2$ or greater but 0.45 mg/cm$^2$ or less, and a deposition amount of the invisible toner per unit area of the invisible toner image is less than a deposition amount of the color toner per unit area of the color toner image.

<12> The image forming method according to <8> to <11>, wherein a two-dimensional coding image (i) that is the invisible toner image is formed closer to the recording medium than a two-dimensional coding image (c) that is the color toner image, information the two-dimensional coding image (i) has is different from information the two-dimensional coding image (c) has, and when the color toner image is a solid image, absorbance of the solid image at 800 nm or longer but 900 nm or shorter is less than 0.05.

<18> An image forming apparatus including:

an electrostatic latent image-bearing member;

an electrostatic latent image-forming unit configured to form an electrostatic latent image on the electrostatic latent image-bearing member;

a developing unit configured to develop the electrostatic latent image to form a toner image and storing an invisible toner for forming an invisible toner image and a color toner for forming a color toner image;

a transferring unit configured to transfer the toner image to a recording medium; and a fixing unit configured to fix the toner image transferred to the recording medium, wherein the invisible toner includes a binder resin and a near infrared light-absorbing material, the color toner includes a binder resin and a colorant, the toner image includes the invisible toner image and the color toner image, the invisible toner image includes the binder resin and the near infrared light-absorbing material, the color toner image includes the binder resin and the colorant, when the invisible toner image is a solid image, 60-degree glossiness of the solid image is 30 or greater, and the 60-degree glossiness of the solid image when the invisible toner image is the solid image is higher by 10 or higher than 60-degree glossiness of a solid image when the color toner image is the solid image.

<14> An image forming apparatus including:

an electrostatic latent image-bearing member;

an electrostatic latent image-forming unit configured to form an electrostatic latent image on the electrostatic latent image-bearing member;

a developing unit configured to develop the electrostatic latent image to form a toner image and storing an invisible toner for forming an invisible toner image and a color toner for forming a color toner image;

a transferring unit configured to transfer the toner image to a recording medium; and a fixing unit configured to fix the toner image transferred to the recording medium, wherein the invisible toner includes a binder resin and a near infrared light-absorbing material, the color toner includes a binder resin and a colorant, the toner image includes the invisible toner image and the color toner image, the invisible toner image includes the binder resin and the near infrared light-absorbing material, the color toner image includes the binder resin and the colorant, loss tangent (tan δi) of the invisible toner at from 100 degrees Celsius through 140 degrees Celsius is 2.5 or greater, and loss tangent (tan δc) of the color toner at from 100 degrees Celsius through 140 degrees Celsius is 2 or less.

The toner set according to any one of <1> to <7>, the image forming method according to any one of <8> to <12>, and the image forming apparatus according to <18> or <14> can solve the above-described various problems existing in the art and can achieve the object of the present disclosure.

DESCRIPTION OF THE REFERENCE NUMERAL

14: image processing unit (IPUL)
15: writing unit
16: paper feeding unit
17: fixed-transfer-paper conveyance unit
21: photoconductor drum for black (Bk) toner and developer
22: photoconductor drum for yellow (Y) toner and developer
23: photoconductor drum for magenta (M) toner and developer
24: photoconductor drum for cyan (C) toner and developer
20: photoconductor drum

The invention claimed is:

1. An image forming method comprising:

forming an electrostatic latent image on an electrostatic latent image-bearing member;

developing the electrostatic latent image to form a toner image;

transferring the toner image to a recording medium; and fixing the toner image transferred on the recording medium, wherein the toner image includes an invisible toner image and a color toner image, wherein the invisible toner image is formed closer to the recording medium than the color toner image, the invisible toner image is formed with an invisible toner including a binder resin and a near infrared light-absorbing material, the color toner image is formed with a color toner including a binder resin and a colorant, when the invisible toner image is a solid image, 60-degree glossiness of the solid image is 30 or greater, and the 60-degree glossiness of the solid image when the invisible toner image is the solid image is higher by 10 or higher than 60-degree glossiness of a solid image when the color toner image is the solid image.

2. The method according to claim 1, wherein loss tangent (tan δi) of the invisible toner at from 100 degrees Celsius through 140 degrees Celsius is 2.5 or greater, and loss tangent (tan δc) of the color toner at from 100 degrees Celsius through 140 degrees Celsius is 2 or less.

3. The according to claim 1, wherein a weight average particle diameter of the invisible toner is 5.0 micrometers or greater but 7.0 micrometers or less.

4. The method according to claim 1, wherein the color toner is a cyan toner, a magenta toner, a yellow toner, or a black toner, and absorbance of the solid image of the color toner at 800 nm or longer is less than 0.05.

5. The method according to claim 4, wherein the black toner includes a compound having a perylene structure.

6. The image forming method according to claim 1, wherein a deposition amount of the invisible toner of the invisible toner image is 0.30 mg/cm$^2$ or greater but 0.45 mg/cm$^2$ or less, and a deposition amount of the invisible toner per unit area of the invisible toner image is less than a deposition amount of the color toner per unit area of the color toner image.

7. The image forming method according to claim 1, wherein a two-dimensional coding image (i) that is the invisible toner image is formed closer to the recording medium than a two-dimensional coding image (c) that is the color toner image, information the two-dimensional coding image (i) has is different from information the two-dimensional coding image (c) has, and when the color toner image is a solid image, absorbance of the solid image at 800 nm or longer but 900 nm or shorter is less than 0.05.

8. An image forming method comprising:

forming an electrostatic latent image on an electrostatic latent image-bearing member;

developing the electrostatic latent image to form a toner image;

transferring the toner image to a recording medium; and fixing the toner image transferred on the recording medium, wherein the toner image includes an invisible toner image and a color toner image, wherein a two-dimensional coding image (i) that is the invisible toner image is formed closer to the recording medium than a two-dimensional coding image (c) that is the color toner image, information the two-dimensional coding image (i) has is different from information the two-dimensional coding image (c) has, and when the color toner image is a solid image, absorbance of the solid image at 800 nm or longer but 900 nm or shorter is less than 0.05, the invisible toner image is formed with an invisible toner including a binder resin and a near infrared light-absorbing material, the color toner image is formed with a color toner including a binder resin and a colorant, when the invisible toner image is a solid image, 60-degree glossiness of the solid image is 30 or greater, and the 60-degree glossiness of the solid image when the invisible toner image is the solid image is higher by 10 or higher than 60-degree glossiness of a solid image when the color toner image is the solid image.

9. The method according to claim 8, wherein loss tangent (tan δi) of the invisible toner at from 100 degrees Celsius through 140 degrees Celsius is 2.5 or greater, and loss tangent (tan δc) of the color toner at from 100 degrees Celsius through 140 degrees Celsius is 2 or less.

10. The method according to claim 8, wherein a weight average particle diameter of the invisible toner is 5.0 micrometers or greater but 7.0 micrometers or less.

11. The method according to claim 8, wherein the color toner is a cyan toner, a magenta toner, a yellow toner, or a black toner, and absorbance of the solid image of the color toner at 800 nm or longer is less than 0.05.

12. The method according to claim 11, wherein the black toner includes a compound having a perylene structure.

13. The image forming method according to claim 8, wherein a deposition amount of the invisible toner of the invisible toner image is 0.30 $mg/cm^2$ or greater but 0.45 $mg/cm^2$ or less, and a deposition amount of the invisible toner per unit area of the invisible toner image is less than a deposition amount of the color toner per unit area of the color toner image.

* * * * *